US007507162B2

(12) United States Patent
Jackson et al.

(10) Patent No.: US 7,507,162 B2
(45) Date of Patent: Mar. 24, 2009

(54) ORBITAL WALKER WITH ACTIVITY TABLE

(75) Inventors: Peter D. Jackson, Alpharetta, GA (US); Jeffrey S. Tadin, Canton, GA (US); Stephen R. Burns, Cumming, GA (US); Jacob M. Sclare, Dacula, GA (US); James E. Cartabiano, Gainesville, GA (US)

(73) Assignee: Kids II, Inc., Alpharetta, GA (US)

( * ) Notice: Subject to any disclaimer, the term of this patent is extended or adjusted under 35 U.S.C. 154(b) by 200 days.

(21) Appl. No.: 11/740,666

(22) Filed: Apr. 26, 2007

(65) Prior Publication Data

US 2007/0265144 A1 Nov. 15, 2007

Related U.S. Application Data

(63) Continuation-in-part of application No. 11/036,199, filed on Jan. 14, 2005, now Pat. No. 7,247,100.

(60) Provisional application No. 60/536,784, filed on Jan. 16, 2004.

(51) Int. Cl.
*A63G 1/12* (2006.01)

(52) U.S. Cl. ..... 472/14; 472/135; 482/66; 297/137

(58) Field of Classification Search ..... 472/14, 472/15, 135; 446/227; 482/66–69; 297/137–139, 297/273–276
See application file for complete search history.

(56) References Cited

U.S. PATENT DOCUMENTS

| | | | |
|---|---|---|---|
| 68,637 | A | 9/1867 | Mason |
| 71,220 | A | 11/1867 | Rohr |
| 82,304 | A | 9/1868 | Geisler |
| 124,706 | A | 3/1872 | Westlake et al. |
| 341,167 | A | 5/1886 | Pudder |
| 368,477 | A | 8/1887 | Lane et al. |
| 451,128 | A | 4/1891 | Lawson |
| 671,058 | A | 4/1901 | Resetar |
| 822,329 | A | 6/1906 | Wilcox |
| 903,731 | A | 11/1908 | Kull |
| 1,297,018 | A | 3/1919 | Scott |
| 1,297,800 | A | 3/1919 | Cranford |

(Continued)

OTHER PUBLICATIONS

Office Action dated Dec. 22, 2008 cited in U.S. Appl. No. 11/743,952, filed May 3, 2007.

*Primary Examiner*—Kien Nguyen
(74) *Attorney, Agent, or Firm*—Alston & Bird LLP

(57) ABSTRACT

Various embodiments are directed to a children's exercise and activity apparatus. The apparatus includes an activity table, a seat, a connecting beam for connecting the seat to the activity table, and one or more legs connected to and depending downwardly from the seat to the floor to support the seat and prevent the seat from tipping over when a child is supported therein. The seat has a pair of leg openings that allow the child to touch the floor with its legs, and the connecting beam is rotatably connected to the activity table so that the child in the seat can travel in an orbital path around the activity table. In addition, the angular rotation of the seat may be limited to prevent the child from rotating the seat to a point at which the child could walk along the floor and move the apparatus along with the child.

20 Claims, 24 Drawing Sheets

U.S. PATENT DOCUMENTS

| | | | |
|---|---|---|---|
| 1,437,179 | A | 11/1922 | Herson |
| 1,469,436 | A | 10/1923 | Forina |
| D119,382 | S | 3/1940 | DePuy |
| 2,308,626 | A | 1/1943 | Reinholz |
| 2,352,450 | A | 6/1944 | Reinholz |
| 2,499,164 | A | 2/1950 | Richardson |
| 3,049,350 | A | 8/1962 | Walker |
| 3,127,170 | A | 3/1964 | Caster |
| 3,721,437 | A | 3/1973 | Skaricic |
| 3,730,587 | A | 5/1973 | Bloxham et al. |
| 3,985,082 | A | 10/1976 | Barac |
| 4,621,804 | A | 11/1986 | Mueller |
| 4,743,008 | A | 5/1988 | Fermaglich et al. |
| 4,795,151 | A | 1/1989 | Mulcaster |
| 4,907,571 | A | 3/1990 | Futakami |
| 5,050,504 | A | 9/1991 | Mulcaster |
| D320,528 | S | 10/1991 | Bernstein et al. |
| 5,085,428 | A | 2/1992 | Fermaglich et al. |
| 5,211,607 | A | 5/1993 | Fermaglich et al. |
| 5,302,163 | A | 4/1994 | Fermaglich et al. |
| 5,366,231 | A | 11/1994 | Hung |
| 5,409,246 | A | 4/1995 | Ali |
| 5,433,682 | A | 7/1995 | Fermaglich et al. |
| 5,577,801 | A | 11/1996 | Glockl |
| 5,590,892 | A | 1/1997 | Hu |
| 5,688,211 | A | 11/1997 | Myers |
| 6,000,750 | A | 12/1999 | Rossman et al. |
| 6,001,047 | A | 12/1999 | Ferrara |
| 6,048,290 | A | 4/2000 | Chen et al. |
| 6,299,247 | B1 | 10/2001 | Meeker et al. |
| D465,440 | S | 11/2002 | Ventrola et al. |
| 7,025,364 | B1 | 4/2006 | Clarke |
| 7,097,599 | B2 * | 8/2006 | Gates ..... 482/66 |

* cited by examiner

ORBITAL WALKER WITH ACTIVITY TABLE

CROSS-REFERENCE TO RELATED APPLICATIONS

This application is a continuation-in-part application of U.S. patent application Ser. No. 11/036,199 entitled "Orbital Walker with Activity Table" and filed on Jan. 14, 2005 now U.S. Pat. No. 7,247,100, which is hereby incorporated by reference in its entirety and which claims priority from provisional U.S. Patent Application No. 60/536,784 entitled "Orbital Walker with Activity Table" and filed on Jan. 16, 2004 and which is hereby incorporated by reference in its entirety.

BACKGROUND OF THE INVENTION

Stationary walkers are used to assist children in the development of the leg muscles and coordination needed for walking. A typical stationary walker includes a seat portion that is positioned in the center of a walker and is at least partially surrounded by an annular-shaped activity tray. The activity tray includes toys that entertain the child. The stationary walker is held in a stationary position by legs that extend downwardly from the activity tray. In most stationary walkers, the seat portion can rotate 360°, independently of the activity tray, about an axis of rotation that is defined by the center of the seat portion.

An orbital walker differs from a stationary walker in that the orbital walker includes a seat portion that is connected to a stationary platform and configured to move along an orbital path around the center of the stationary platform. A child in the seat portion can move his or her legs along the floor to cause the seat portion to travel along the orbital path. This type of walker allows the child to practice the skill of walking while preventing the child from moving outside of the orbital path.

U.S. Pat. No. 5,433,682 to Fermaglich ("the '682 Patent") discloses an orbital walker that includes a combined tray and seat that are attached to a stationary base such that the tray and seat can be revolved conjointly around the base in an orbital manner. However, because the tray, which can contain toys, moves with the child, the child has greatly reduced motivation to move itself around the stationary base.

U.S. Pat. No. 5,211,607 to Fermaglich ("the '607 Patent") discloses an orbital walker that includes a central activity tray separate from the seat portion, allowing the child to move in an orbital path around the activity tray. For one orbital walker, the seat assembly is attached to one end of a V-shaped mounting arm. The center of the mounting arm is rotatably connected to a central vertical rod extending upwardly from a support surface and supporting an activity table, and a counterweight is mounted to the opposite end of the arm to prevent the seat assembly from tipping over.

U.S. Pat. No. 3,127,170 to Caster ("the '170 Patent") discloses a play table top mounted on top of a vertical column and a chair that is attached to a horizontal rod extending from the vertical column. An L-shaped rod is provided that extends vertically from the bottom of the seat and then inwardly towards the vertical column. The end of the horizontal leg of the L-shaped rod engages a lower track, which is positioned around the perimeter of a lower base supporting the vertical column. The lower base is supported by wheeled legs above the support surface. The child moves around the table by using its arms to pull itself around the table and its legs to push against the lower base to move around the table. However, because the chair is not designed with the intent that the child can stand up while positioned therein, the walker does not assist a child with the development of the leg muscles needed for walking as much as a walker wherein a child can stand.

U.S. Pat. No. 2,499,164 to Richardson ("the '164 Patent") discloses a swing or seat that is suspended downwardly from the center of an inverted U-shaped frame. The center of the frame is attached to a horizontal arm, and the horizontal arm is rotatably attached to a vertical rod, allowing the frame and seat to rotate around the vertical rod. A play table is attached to the vertical rod between the floor and the position of the horizontal arm on the vertical rod. The seat is suspended from the center of the U-shaped frame by a tension spring. The spring allows a child seated in the swing to bounce vertically and swing through the frame, and wheels attached to the bottom of the frame allow the child to move the seat and frame in an orbital path around the activity table. However, the U-shaped frame and the members supporting the sling make it difficult for parents or other caregivers to place the child in the sling and remove the child from the sling. In addition, the assembly does not allow the child to rotate about the central axis of the seat, meaning that the walking function permits only a sideways walking direction.

Therefore, an unsatisfied need in the art exists for an orbital walker that is able to move in an orbital path around an activity table and provide an easily assembled support structure that prevents a child seated in the walker from tipping over.

BRIEF SUMMARY OF THE INVENTION

The invention is directed to a children's exercise and activity apparatus for providing cognitive development activities for small children and exercise functionality. The apparatus includes an activity table adapted for receiving one or more children's activity items, a seat for supporting a child above the floor, a connecting beam for connecting the seat to the activity table at a location on the activity table below an upper surface of the activity table, and one or more legs connected to and depending downwardly from the seat to the floor to support the seat and prevent the seat from tipping over when a child is supported therein. The seat has a pair of leg openings that allow the child to touch the floor with its legs, and the connecting beam is rotatably connected to the activity table so that the child in the seat can travel in an orbital path around the activity table.

In one embodiment, the connecting beam includes an annular collar that fits around a pedestal that supports the activity table. The annular collar further includes a draw latch fastener to secure the collar around the pedestal quickly and easily, preventing the annular collar and connecting beam from moving away from the pedestal while a child is in the seat.

In another embodiment, the range of motion that the seat can travel around the activity table can be partially limited by engaging a locking pin through the connecting beam and into an annular raceway positioned on the underside of the activity table. The motion of the seat can also be fully limited by engaging the locking pin through the connecting beam and into a stop hole located on the underside of the activity table.

In another embodiment of the invention, a seat assembly is provided that includes a seat for supporting a child above a floor, a connecting beam for connecting the seat adjacent an activity table, an annular collar for securing the connecting beam to a pedestal supporting the activity table, and one or more legs depending from the seat to the floor to prevent the seat from tipping over when a child is supported therein. The seat includes a pair of leg openings that allow the child to touch the floor with its legs. The annular collar includes two segments that are hingedly connected at one end and move apart at the other ends to fit around the pedestal supporting an activity table, and the ends of the annular collar are fastened together after the collar is fit around the pedestal to prevent the connecting beam from moving away from the pedestal.

The activity table can advantageously be adapted for receiving one or more children's activity items and for use with a seat to support a child. A pedestal extends between a base supported on a floor and the activity table. The activity table has an upper surface for supporting activity items when placed thereon. The pedestal includes an annular upper shelf and an annular lower shelf, and the surface of the pedestal between the shelves is adapted for receiving an annular collar of a beam configured for rotatably connecting the seat to the table. In addition, the surface is adapted for allowing a child in the seat to travel in an orbital path around the table.

BRIEF DESCRIPTION OF THE DRAWINGS

Reference will now be made to the accompanying drawings, which are not necessarily drawn to scale, and wherein.

DETAILED DESCRIPTION OF THE INVENTION

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Generally, the present invention is directed to an orbital walker that allows a child to travel in an orbital path around an activity table. The orbital walker includes a seat, an activity table, a connecting beam, and one or more legs depending downwardly from the seat to the floor. The activity table is mounted above the top of a base. The seat is advantageously connected to the activity table by the connecting beam, which is rotatably connected to the activity table to allow the seat to travel in the orbital path around the activity table. A wheel is mounted on the bottom of each leg, and each wheel is oriented to follow an orbital path around the table. In addition, the seat can be configured to rotate 360° about its own axis and bounce independently of the connecting beam and the activity table using shock absorbers. Furthermore, the connecting beam can be disengaged from the activity table to allow the table to serve as a stand-alone activity center for older children who have learned to walk.

Figure 1:
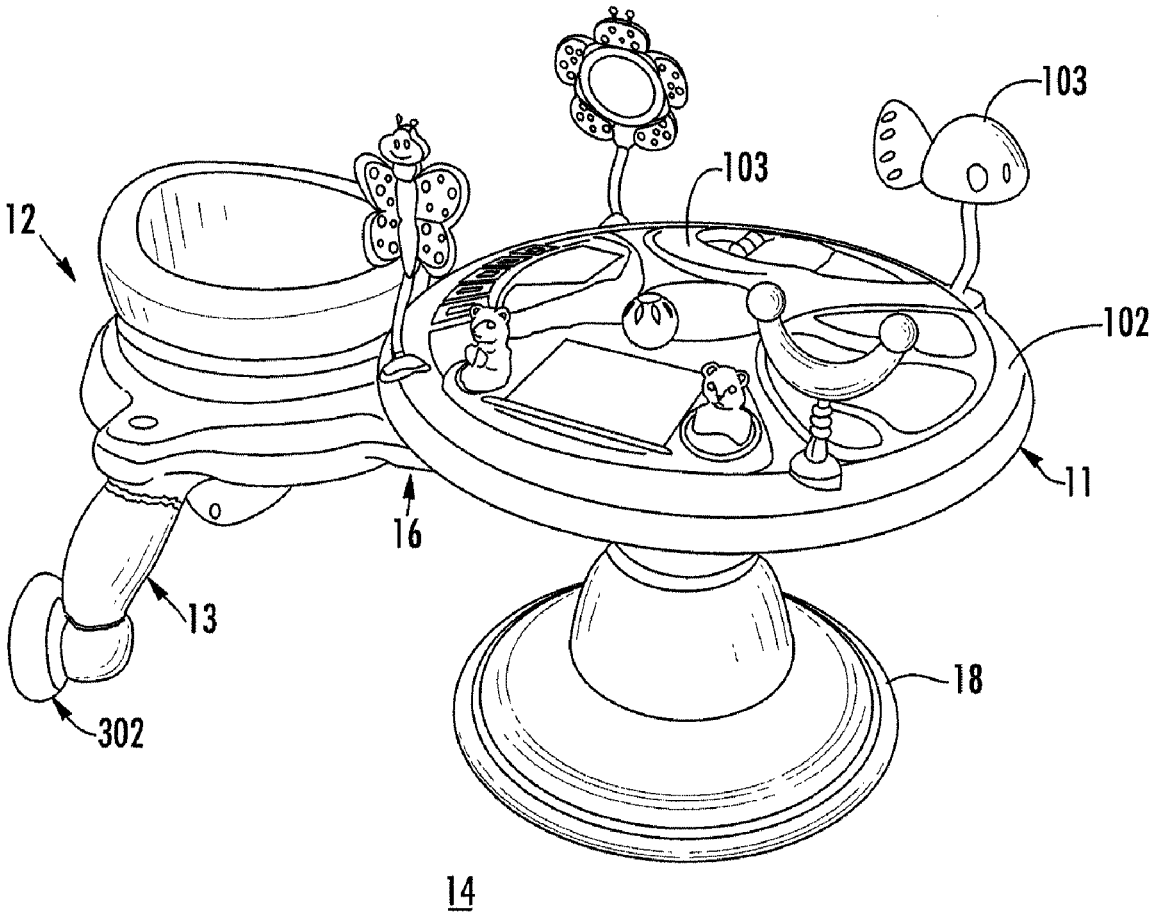
FIG. 1 shows a perspective view of an orbital walker according to one embodiment of the invention.
Figure 2:
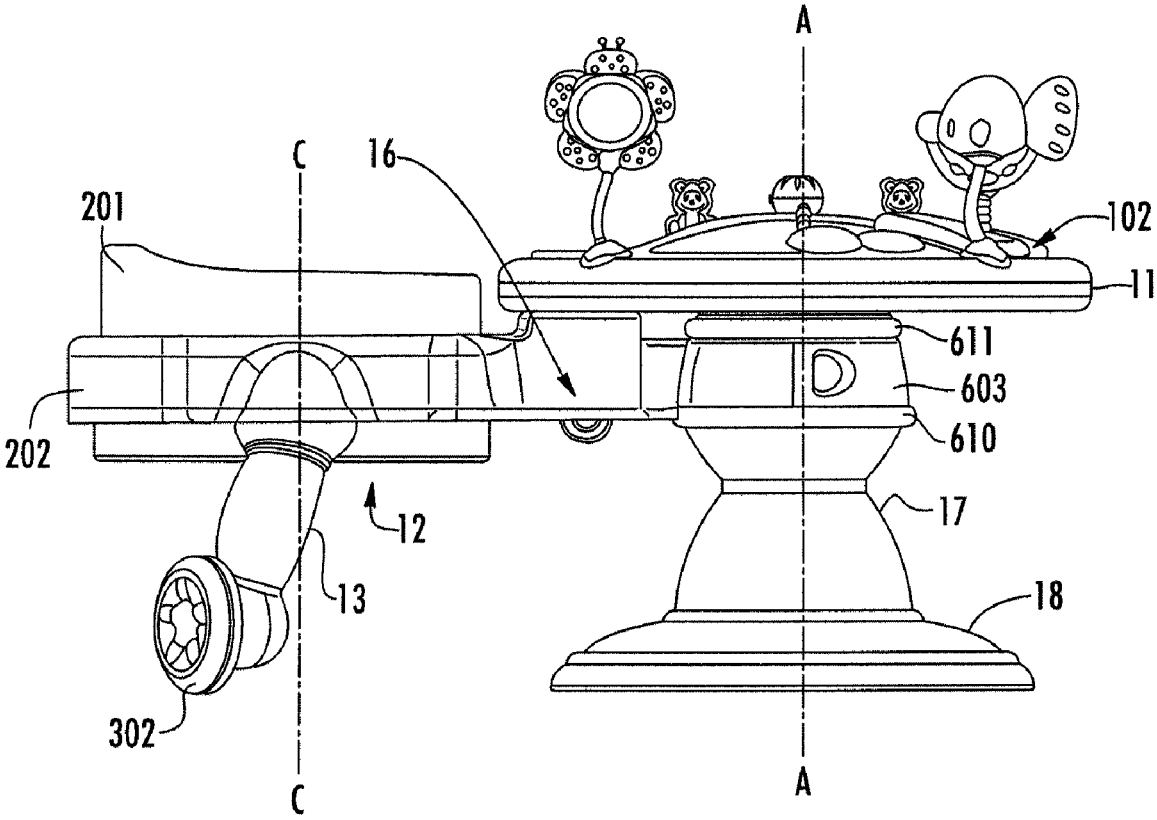
FIG. 2 shows a side view of an orbital walker according to one embodiment of the invention.
Figure 3:
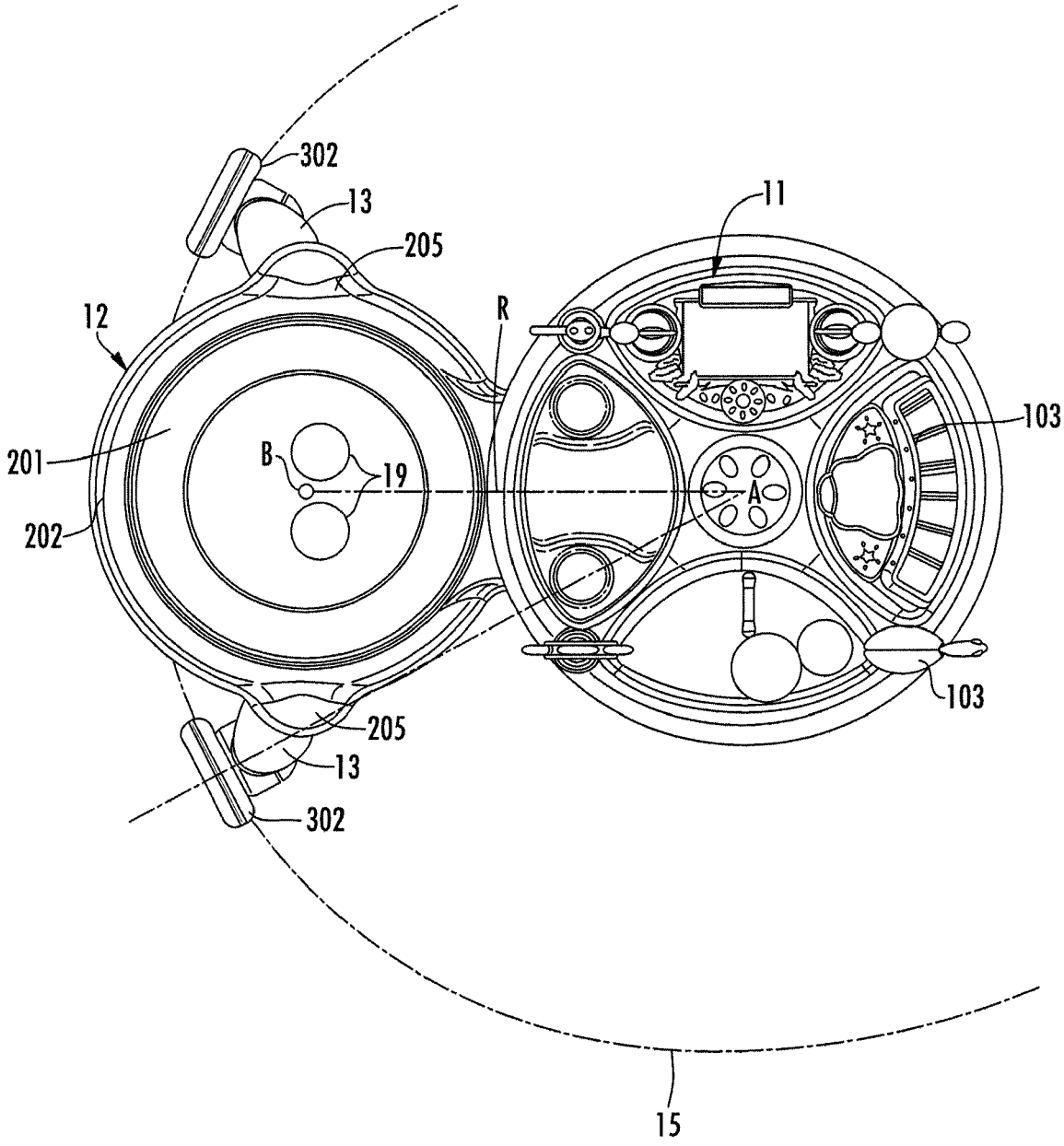
FIG. 3 shows a top view of an orbital walker according to one embodiment of the invention.

As shown in FIG. 1, one embodiment of the invention is a children's exercise and activity apparatus for providing activities and exercise functionality for small children. The apparatus includes an activity table 11 with a base 18 supported on a floor 14 or other support surface, a seat 12 for supporting a child above the floor 14, a connecting beam 16 for rotatably connecting the seat 12 to the activity table 11, and one or more legs 13 that depend downwardly from the seat 12 to the floor 14 to prevent the seat 12 from tipping over when a child is supported in the seat 12. The table 11 includes an upper surface 102 for supporting activity items 103, such as toys, teething rings, and interactive learning modules. As shown in FIGS. 2 and 3, the connecting beam 16 is rotatably connected to the activity table 11 below the upper surface 102 of the activity table 11 so that the child in the seat 12 can travel in an orbital path 15 around the activity table 11. Further, as shown in FIG. 3, the seat 12 defines a pair of leg openings 19 that allow the child to touch the floor with its legs.

Connecting Beam and Pedestal

Figure 5:
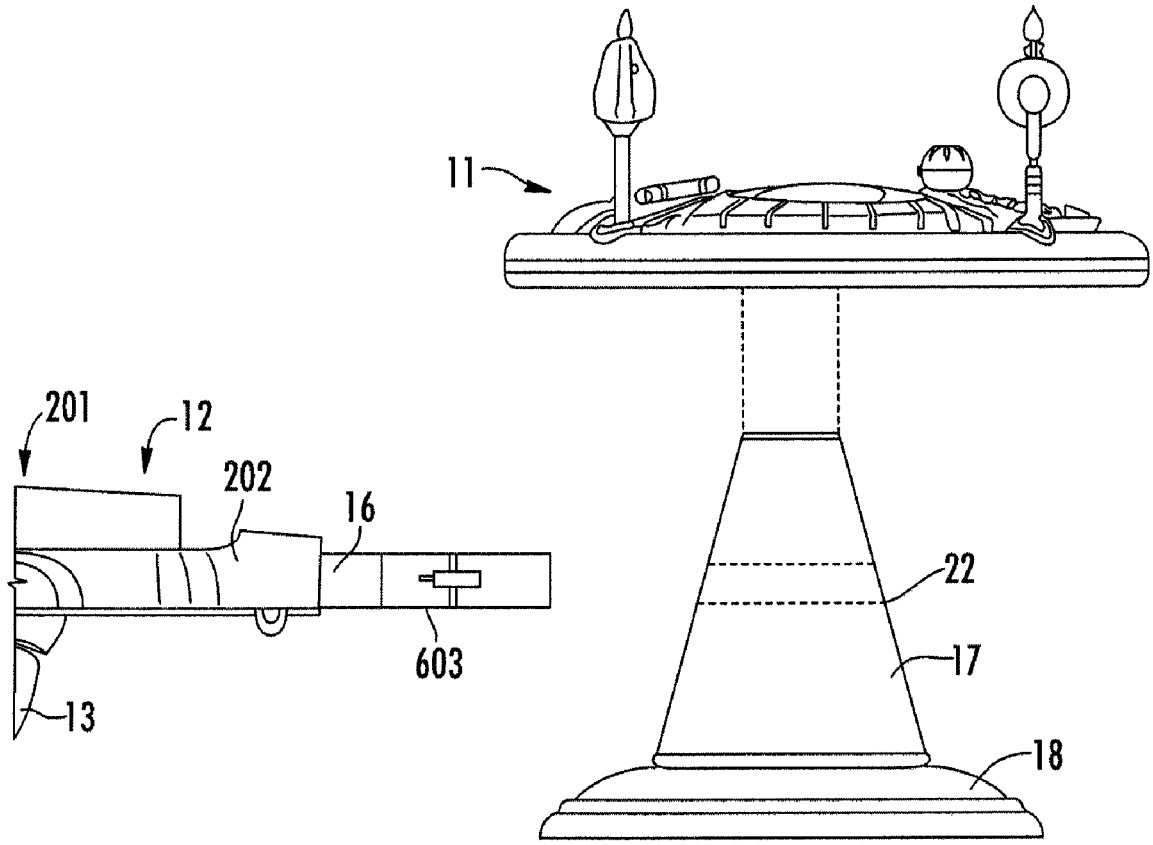
FIG. 5 shows a side view of a pedestal and an annular collar of a connecting beam according to one embodiment of the invention.

As shown in FIG. 2, a pedestal 17 is provided between the upper surface 102 of the table 11 and the base 18. The connecting beam 16 includes an annular collar 603 for fitting around the pedestal 17 and rotating with respect to the pedestal 17. In one embodiment, shown in FIG. 5, the annular collar 603 fits over the top of and down the pedestal 17 before the table 11 is attached to the top of the pedestal 17. In this embodiment, the pedestal 17 can have a mounting portion 22 about which the annular collar 603 can rotate, wherein the outer diameter of the pedestal 17 increases from the top of the pedestal 17 to the mounting portion 22 such that the mounting portion 22 of the pedestal 17 has an outer diameter that is substantially equal to the inner diameter of the annular collar 603.

Figure 6:
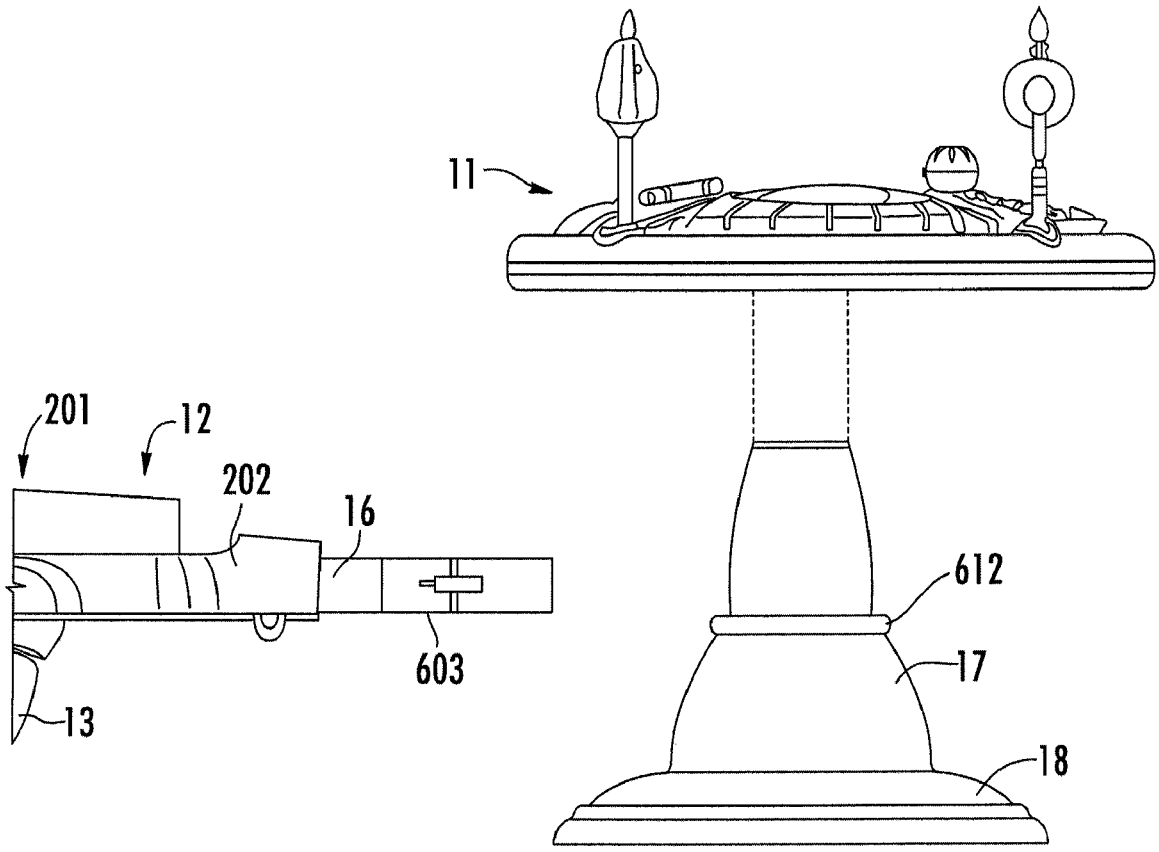
FIG. 6 shows a side view of a pedestal and an annular collar of a connecting beam according to one embodiment of the invention.

In another embodiment, shown in FIG. 6, the pedestal 17 includes an annular shelf 612, or ridge, that extends past the periphery of the pedestal 17 and has a diameter that is greater than the inner diameter of the annular collar 603. The bottom surface of the annular collar 603 is attached to the pedestal 17 such that the bottom surface of the annular collar 603 contacts the upper surface of the annular shelf 612. The annular collar 603 is prevented from moving down the pedestal 17 by the annular shelf 612.

Figure 7:
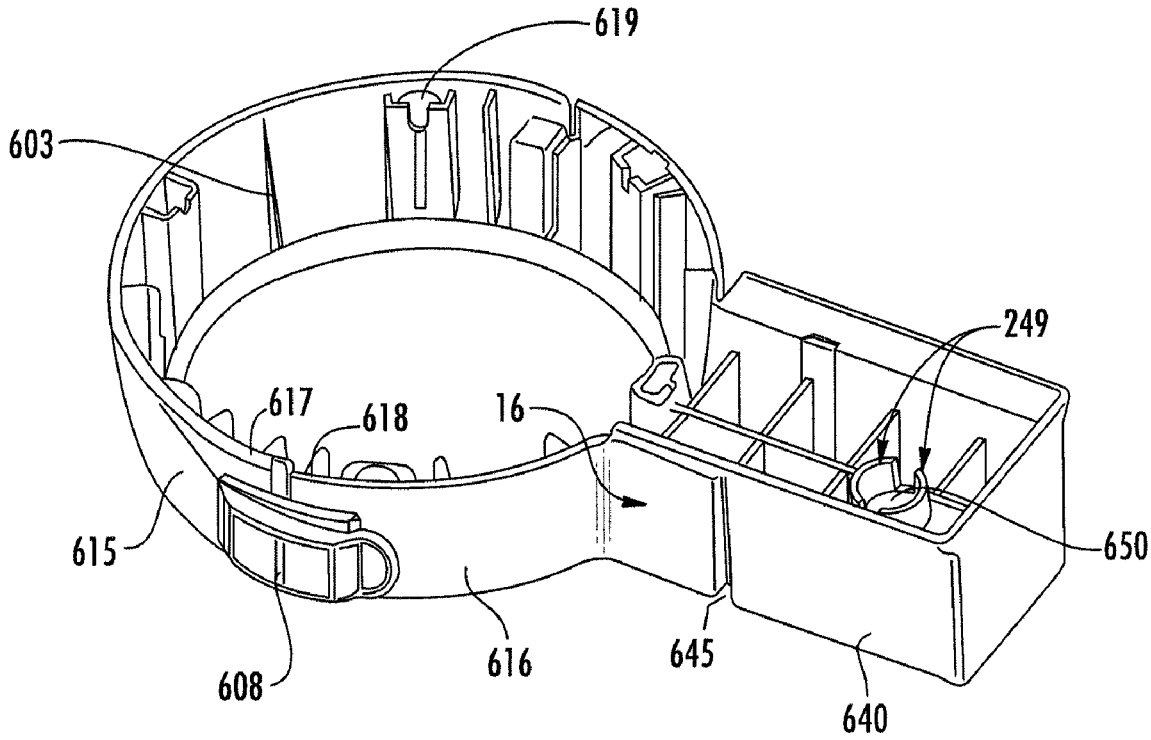
FIG. 7 shows a perspective view of an underside of a connecting beam according to one embodiment of the invention.

As shown in FIG. 7, the annular collar 603 can include two segments 615, 616 that are hingedly connected together to allow the ends 617, 618 of each segment 615, 616 to move apart and towards each other. To attach the annular collar 603 to the pedestal 17, the ends 617, 618 are moved apart from each other, wrapped around the pedestal 17, and moved towards each other to secure the collar 603 in rotatable engagement with the pedestal 17. A fastener 608, such as a draw latch and tab or an eye loop and hook, is included on the ends 617, 618. The fastener 608 is engaged to hold the two segments 615, 616 together around the pedestal 17, preventing the connecting beam 16 from moving away from the pedestal 17. To use the activity table 11 as a standalone toy, the fastener 608 is disengaged and the connecting beam 16 can be removed from the pedestal 17.

Figure 8:
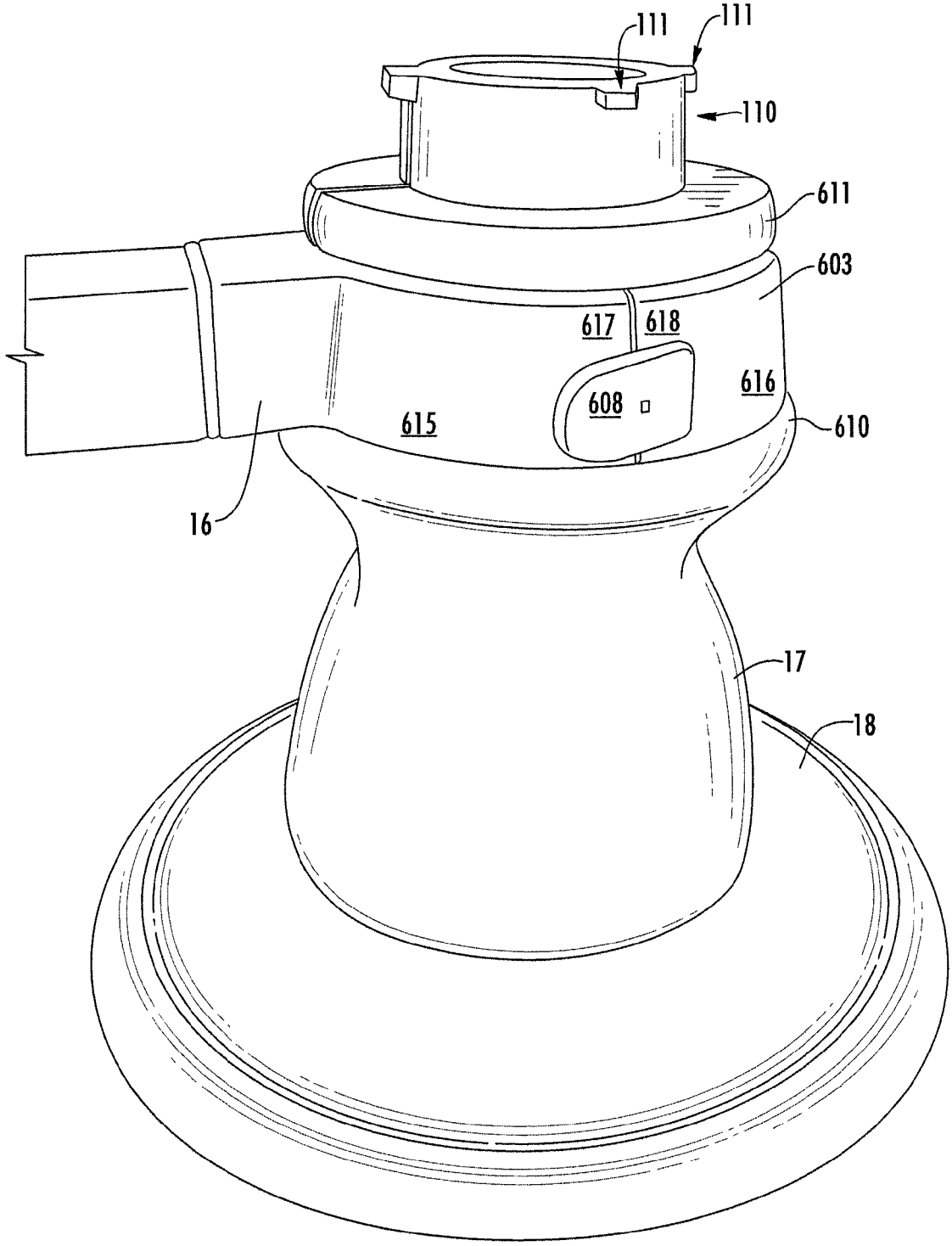
FIG. 8 shows a side view of a pedestal and connecting beam according to one embodiment of the invention.

As shown in FIGS. 2 and 8, the pedestal 17 can include an annular upper shelf 611 and an annular lower shelf 610, similar to the annular shelf 612 described above, to prevent the annular collar 603 from sliding up and down on the pedestal 17. The shelves 610, 611 extend from the periphery of the pedestal 17 and have a diameter that is larger than the inner diameter of the annular collar 603. The lower surface of the annular collar 603 fits adjacent the upper surface of the annular lower shelf 610, and the upper surface of the annular collar 603 fits adjacent the lower surface of the annular upper shelf 611.

Figure 9:
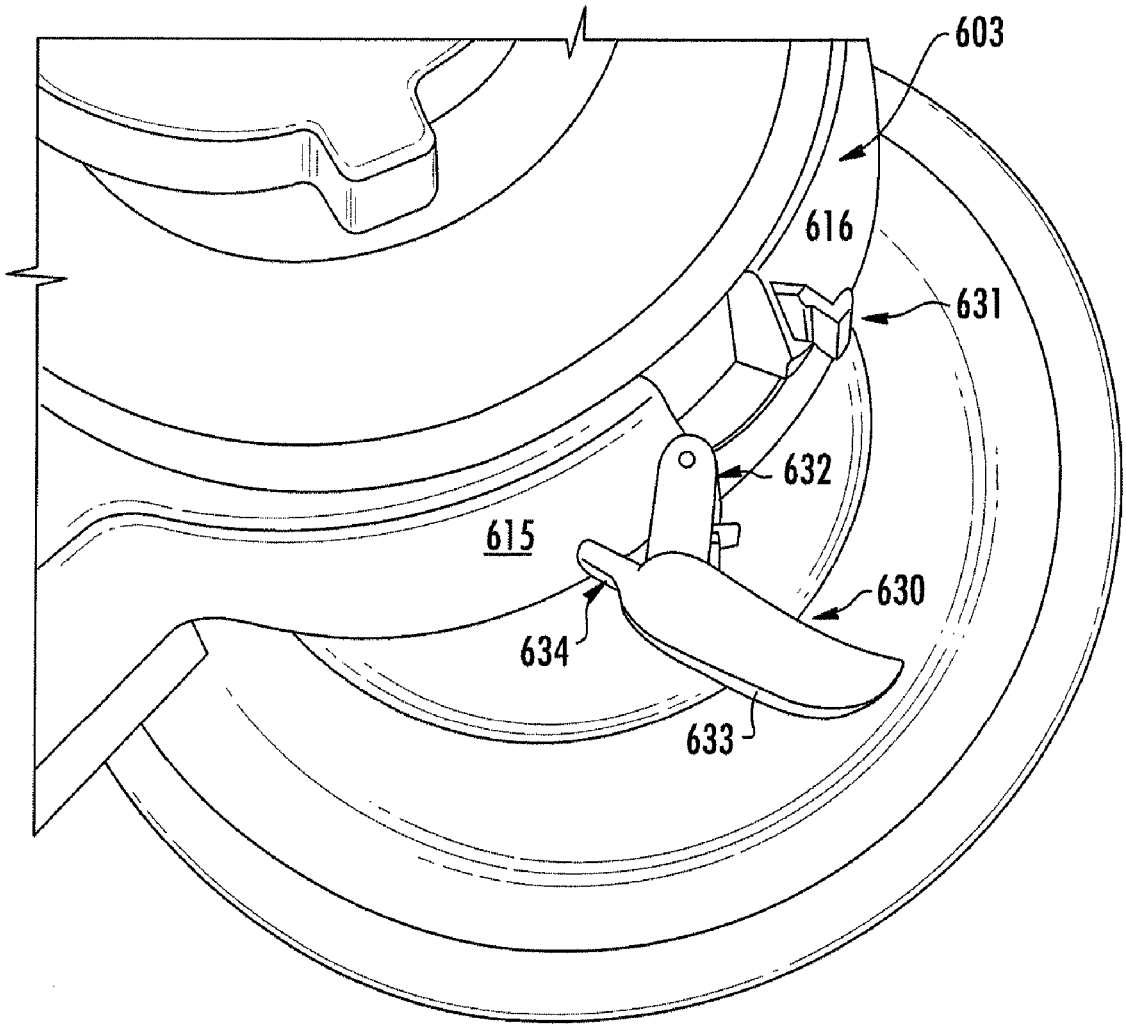
FIG. 9 shows a top view of a pedestal and connecting beam according to one embodiment of the invention.

As described above in relation to FIG. 7, one embodiment of the connecting beam 16 includes two segments 615, 616 that are hingedly connected to move apart to receive the pedestal 17 and towards each other to secure the connecting beam 16 to the pedestal 17. Fasteners 608 are attached to the ends of the segments 615, 616 to prevent the segments 615, 616 from moving apart from each other when the segments 615, 616 are mounted around the pedestal 17. As shown in FIGS. 8 and 9, the fastener 608 includes a draw latch 630 attached to one segment 615 and a tab 631 attached to the second segment 616. The draw latch 630 includes a hinged connecting portion 632 and a latch portion 633. The hinged connecting portion 632 extends between the end of segment 615 and an end of the latch portion 633 and is pivotably mounted to both. The other end of the latch portion 633 includes a shelf (not shown) that extends inwardly towards the connecting portion 632, and the shelf engages the outer leg of an L-shaped tab 631 mounted on the end of segment 616.

Referring to FIG. 9, to engage the tab 631, the latch portion 633 is moved over and slightly past the tab 631. The end of the latch portion 633 that is connected to the connecting portion 632 is then pushed towards the annular collar 603, which pulls the shelf of the latch portion 633 into engagement with the outer leg of the tab 631. FIG. 8 shows the latch 630 in a closed position. To disengage the latch 630, a finger 634 extending from the end of the latch portion that connects to the connecting portion 632 is pulled in a direction away from the annular collar 603, which causes the connecting portion 632 to move away from the annular collar 603 and releases the shelf of the latch portion 633 from engagement with the outer leg of the tab 631. FIG. 9 shows the latch 630 in an open position.

In a further embodiment, as shown in FIG. 7, the inner wall of the annular collar 603 includes one or more rollers 619 that facilitate the rotation of the annular collar 603 around the pedestal 17. The rollers 619 rotate about an axis perpendicular to the surface of the pedestal 17, such that the rolling surfaces of the rollers 619 are adjacent the top surface of the bottom shelf 610. The rollers 619 rotate about an axis parallel to the central axis A of the pedestal 17, such that the rolling surfaces of the rollers 619 are adjacent the periphery of the pedestal 17.

It should be understood that a hinged or separable annular collar 603 is not necessary in all applications of the invention. For example, for the pedestal embodiments illustrated in FIGS. 5 and 6, the annular collar 603 can be placed around the pedestal 17 by removing the table top and placing the annular collar over the pedestal from its end, and no separation of the annular collar is necessary. Similarly, the collar need not be completely annular, and, for example, may define only a partial circumference so that it can be snapped around the pedestal in a radial direction.

Seat and Legs

As shown in FIG. 2, the seat 12, according to one embodiment, includes a seat carrier ring 201 and a seat support ring 202. The seat carrier ring 201 has an outer diameter that is slightly smaller than the inner diameter of the seat support ring, which allows the seat carrier ring 201 to fit inside of the seat support ring 202 and rotate 360° about an axis of rotation C extending through the center of the seat carrier ring 201, independently of the seat support ring 202. The ability of the seat carrier ring 201 to rotate allows the child to turn 90° from the orbital path 15 and walk around the activity table 11.

Figure 10:
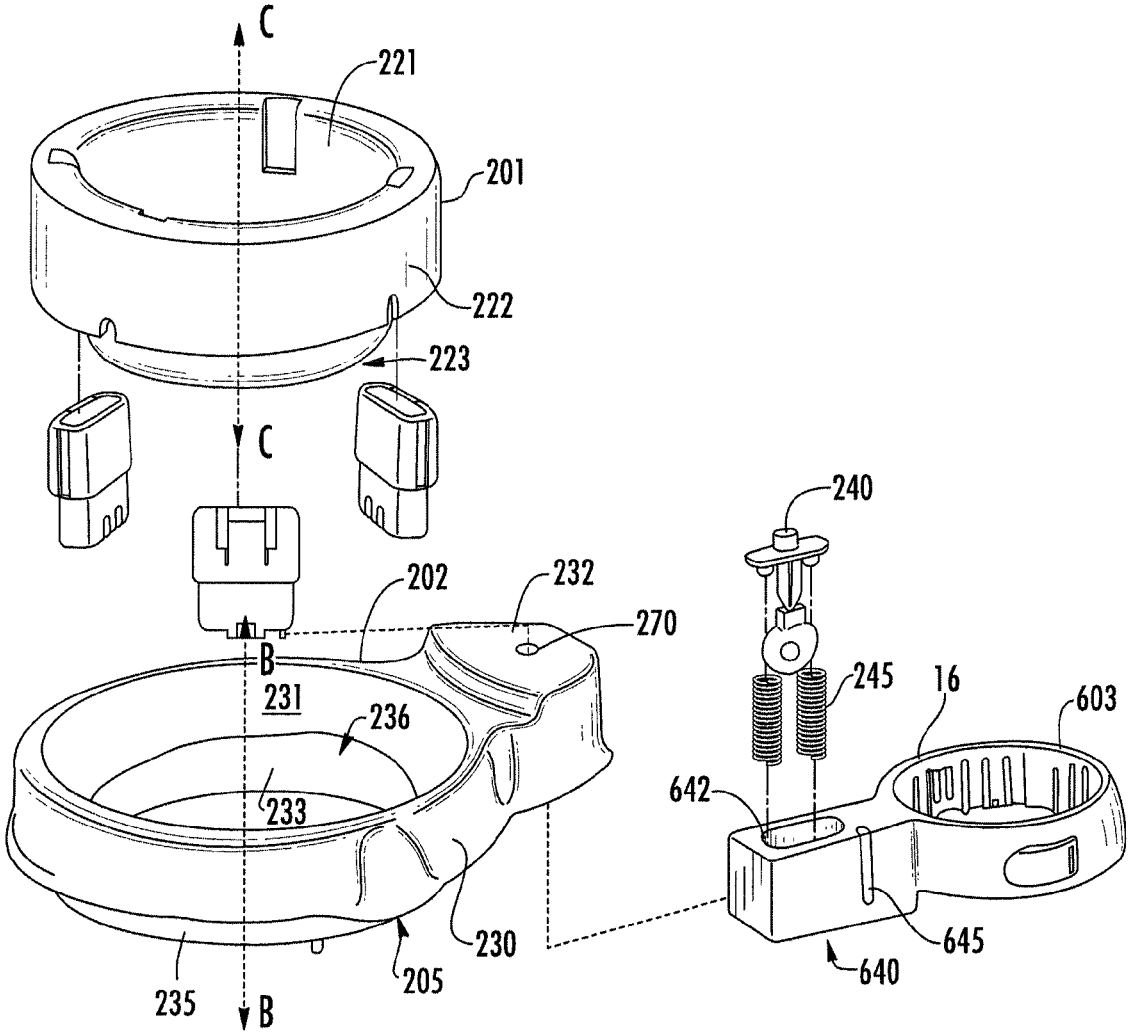
FIG. 10 shows an exploded view of an assembly of a seat carrier ring, a seat support ring, and a connecting beam according to one embodiment of the invention.
Figure 11:
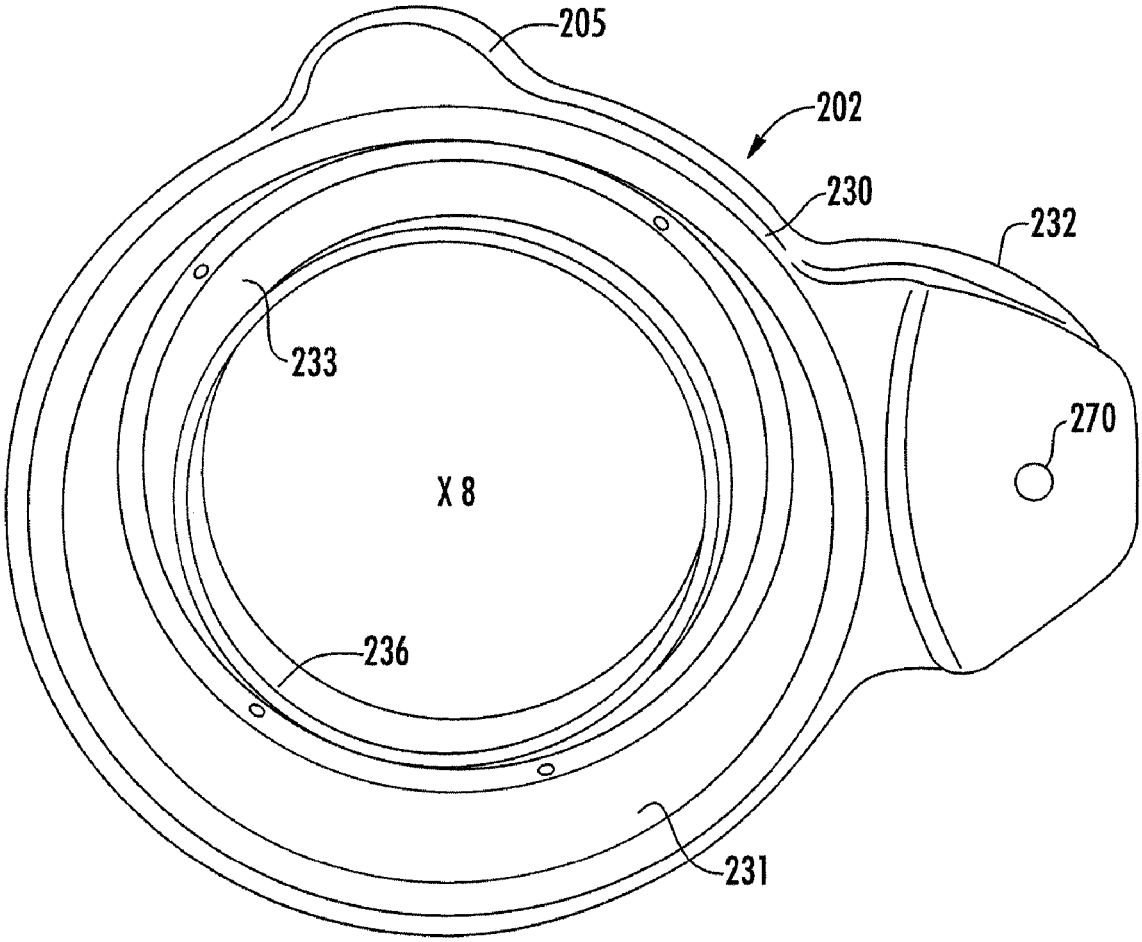
FIG. 11 shows a top view of a seat support ring according to one embodiment of the invention.
Figure 12:
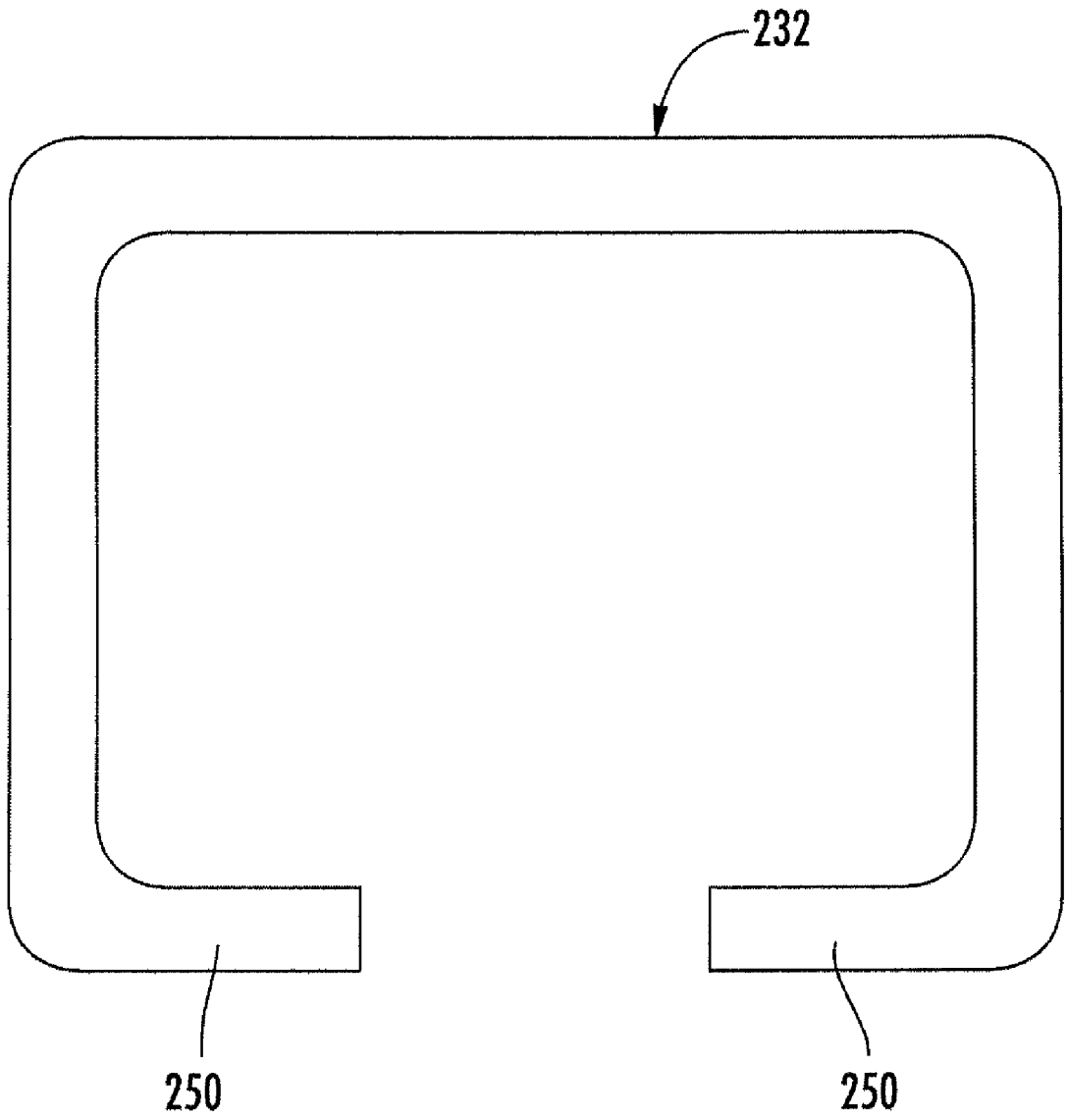
FIG. 12 shows a side view of a beam connecting portion of a seat support ring according to according to one embodiment of the invention.

According to the embodiment shown in FIGS. 10 and 11, the seat support ring 202 includes a central vertical axis B, an outer wall 230, an inner wall 231, one or more leg mounting portions 205, and a beam mounting portion 232. The beam mounting portion 232 extends outwardly from the outer wall 230, in a direction away from axis B. As shown in FIG. 12, the beam mounting portion 232 has a C-shaped cross section, with two horizontal legs 250 for supporting the bottom surface of the end 640 of the connecting beam 16.

According to one embodiment, the end 640 of the connecting beam 16 slides into the C-shaped beam mounting portion 232 such that the bottom surface of the end 640 of the connecting beam 16 rests upon the horizontal legs 250 of the beam mounting portion 232. A screw, snap-fit arrangement, or other suitable fastener known in the art can be utilized to secure the connecting beam 16 to the beam mounting portion 232. In a further embodiment, shown in FIGS. 7 and 10, vertical guides 645 are provided on the outside of the beam 16 to assist an assembler with positioning the end 640 of the connecting beam 16 relative to the beam mounting portion 232. If the connecting beam 16 includes a locking pin 240, as is described below, the C-shaped beam mounting portion 232 allows the bottom portion 244 of the pin 240 to slide between the horizontal legs 250.

In the embodiment shown in FIGS. 10 and 11, the seat support ring 202 further includes one or more leg mounting portions 205. The leg mounting portions 205 are configured for receiving and securely fastening one or more legs 13 to the seat support ring 202, as shown in FIG. 2. In one embodiment, the top portion of each leg 13 is configured to snap into the leg mounting portion 205. In another embodiment, the top portion of each leg 13 includes a bolt or screw that engages a threaded hole extending into the leg mounting portion 205. In addition to snapping configurations, bolts, and screws, other suitable fasteners known in the art may be used to secure each leg 13 to each leg mounting portion 205.

In the embodiments shown in FIGS. 10 and 11, the leg mounting portions 205 extend outwardly from the outer wall 230 of the seat support ring 202. As shown in FIG. 3, the leg mounting portions 205 are positioned on the outer ring 230 along or outside of a radius R defined by the distance between the central vertical axis A of said activity table 11 and the central vertical axis C of said seat support ring 202 for extra stability.

According to one embodiment, shown in FIGS. 1 through 3, a wheel 302 is mounted to the bottom portion of each leg 13. The wheel 302 has an axis of rotation oriented in a direction normal to a line tangent to the central vertical axis A of the activity table 11, which facilitates the rotation of the seat 12 in the orbital path 15 around the table 11. In another embodiment, which is not shown, a roller or caster, which can rotate in any direction, is attached to the bottom portion of each leg 13 to facilitate the movement of the seat 12 in the orbital path 15 around the table 11.

Referring back to FIGS. 10 and 11, a shelf 233 extends inwardly from a bottom portion 235 of the inner wall 231 of the seat support ring 202 in the direction of the axis B. The cross-section of the shelf 233 is wide enough to provide vertical support for a seat carrier ring 201 mounted adjacent to the inner wall 231 of the seat support ring 202. In one embodiment, shown in FIG. 11, the shelf 233 defines a U-shaped raceway, which includes the horizontal shelf 233 between the inner wall 231 of the seat support ring 202 and an inner vertical wall 236 concentric with the inner wall 231 and extending upwardly from the horizontal shelf 233. The raceway receives bearings or wheels positioned below the seat carrier ring 201 to facilitate the rotation of the seat carrier ring 201 relative to the seat support ring 202.

As mentioned above and as shown in FIGS. 10 and 13, one embodiment of the seat carrier ring 201 includes an inner wall 221, an outer wall 222, a bottom surface 223, and a central vertical axis C. The outer wall 222 of the seat carrier ring 201 is positioned adjacent the inner wall 231 of the seat support ring 202 such that the bottom portion 223 of the seat carrier ring 201 is adjacent the shelf 233 of the seat support ring 202. The inner diameter of the seat support ring 202 is slightly larger than the outer diameter of the seat carrier ring 201 to allow the seat carrier ring 201 to rotate relative to the seat support ring 202.

Figure 13:
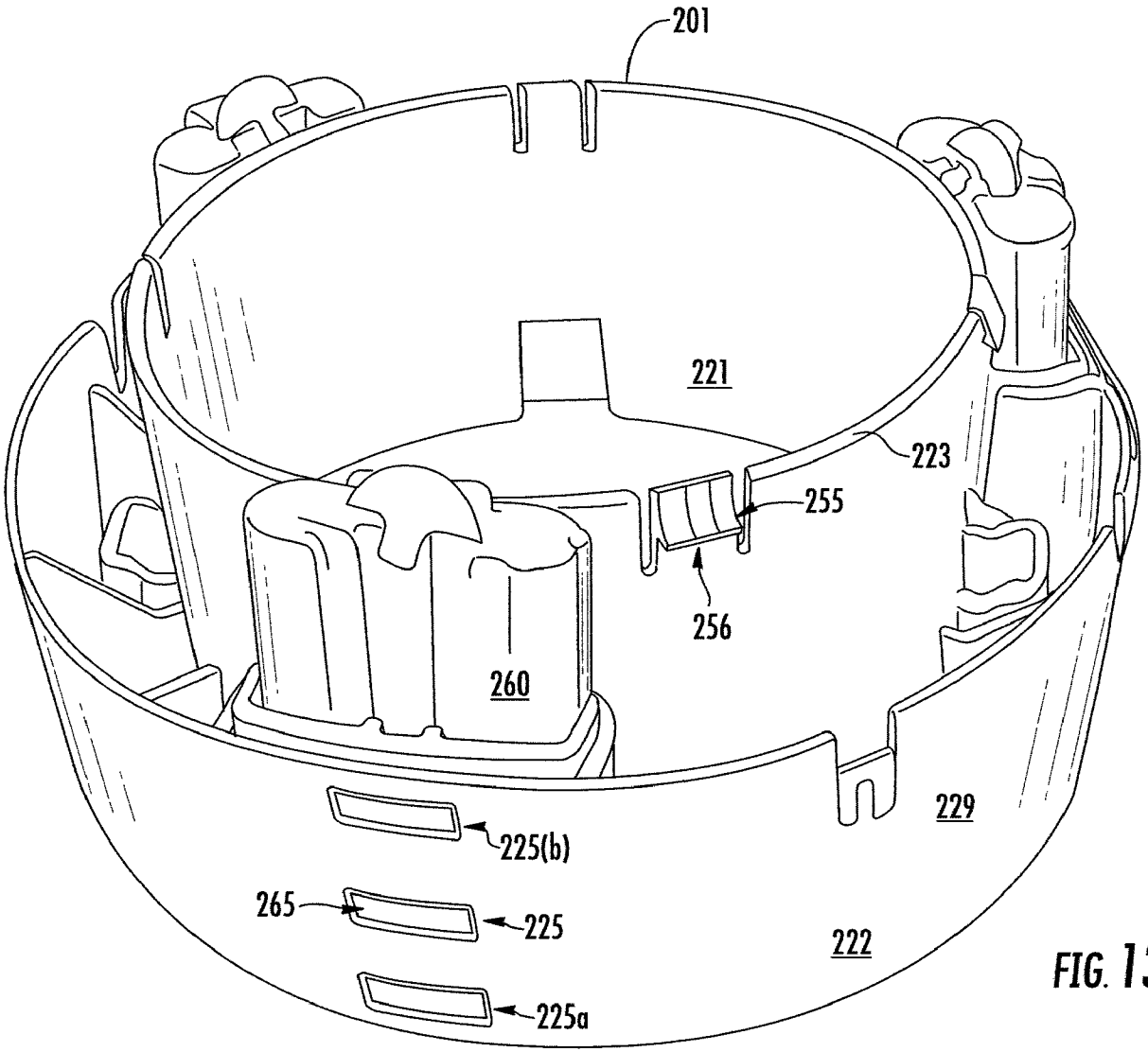
FIG. 13 shows a perspective view of an underside of a seat carrier ring according to one embodiment of the invention.

Furthermore, in one embodiment, as shown in FIG. 13, the bottom portion 223 of the inner wall 221 of the seat carrier ring 201 includes one or more spring tabs 255 that include a horizontal shelf 256 extending away from the central axis C of the seat carrier ring 201. The tabs 255 are configured to bend slightly inwardly towards the central axis C when the seat carrier ring 201 is inserted into the seat support ring 202. When the seat carrier ring 201 is fully inserted into the seat support ring 202, the horizontal shelves 256 of the tabs 255 are positioned below the shelf 233 of the seat support ring 202 such that each horizontal shelf 256 is adjacent the bottom of the shelf 233 of the seat support ring 202, preventing the seat carrier ring 201 from being unintentionally removed from the seat support ring 202. To remove the seat carrier ring 201 from the seat support ring 202, the tabs 255 are pushed inwardly as the seat carrier ring 201 is urged upwardly.

In one embodiment, a compression spring or other type of shock absorber is positioned between the shelf 233 and the bottom portion 223 of the seat carrier ring 201 that engages the shelf 233. The shock absorber allows the seat carrier ring 201 to bounce vertically independently of the seat support ring 202. The shock absorber can be a compression spring, a leaf spring, or other suitable shock absorbing material known in the art.

One embodiment of the shock absorber is mounted adjacent a wheel or bearing to allow the seat carrier ring 201 to facilitate the rotation of the seat carrier ring 201 relative to the seat support ring 202 while providing the seat carrier ring 201 with the ability to bounce vertically independently of the seat support ring 202. For example, in one embodiment, the shock absorber is attached to the seat carrier ring 201 and a bearing or wheel is mounted below the shock absorber. In another embodiment, the shock absorber is positioned on the shelf 233 of the seat support ring 202 and the bearing or wheel is mounted above the shock absorber to engage the bottom portion 223 of the seat carrier ring 201.

Figure 14:
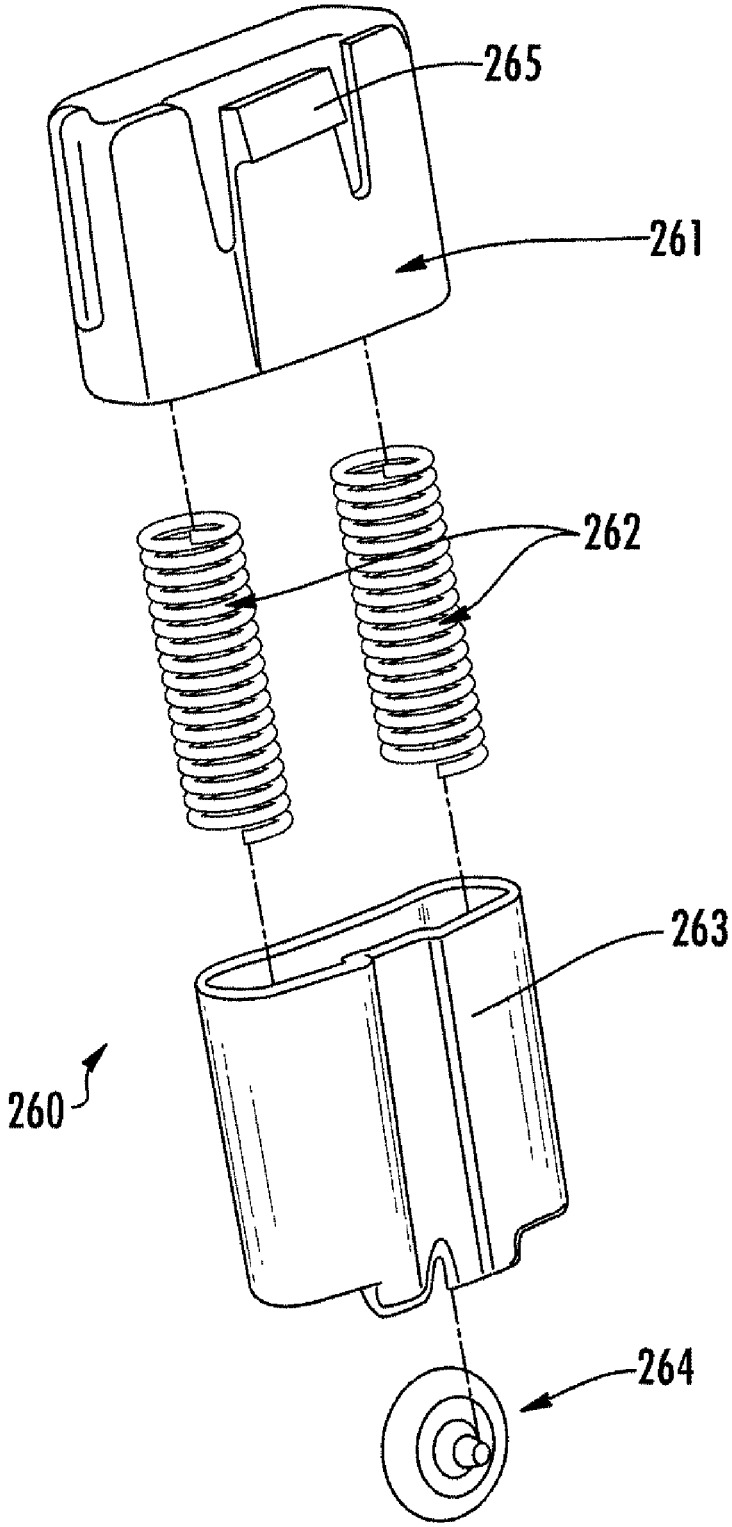
FIG. 14 shows an exploded view of a shock absorber tower according to one embodiment of the invention.
Figure 15:
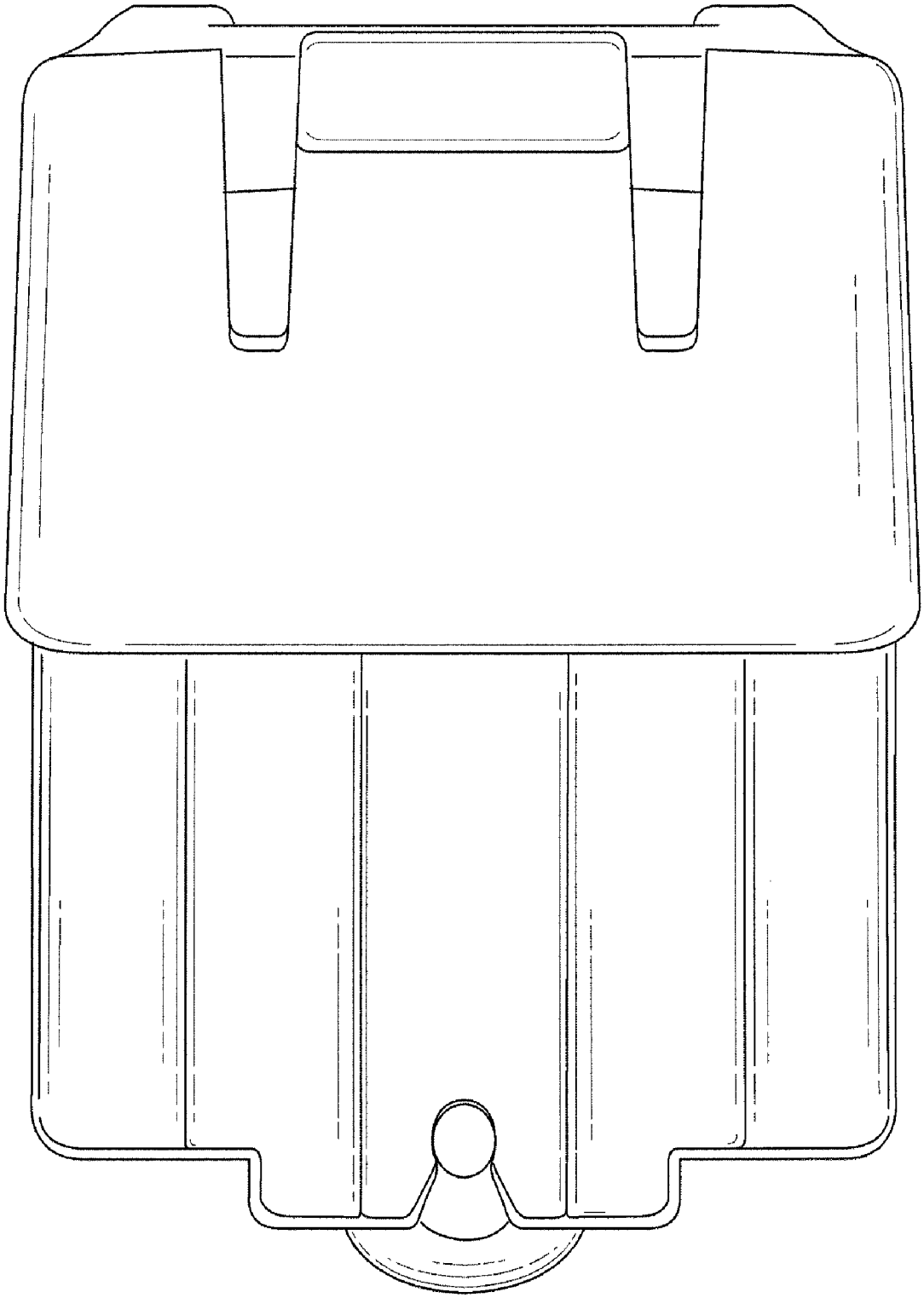
FIG. 15 shows a side view of a shock absorber tower according to one embodiment of the invention.
Figure 16:
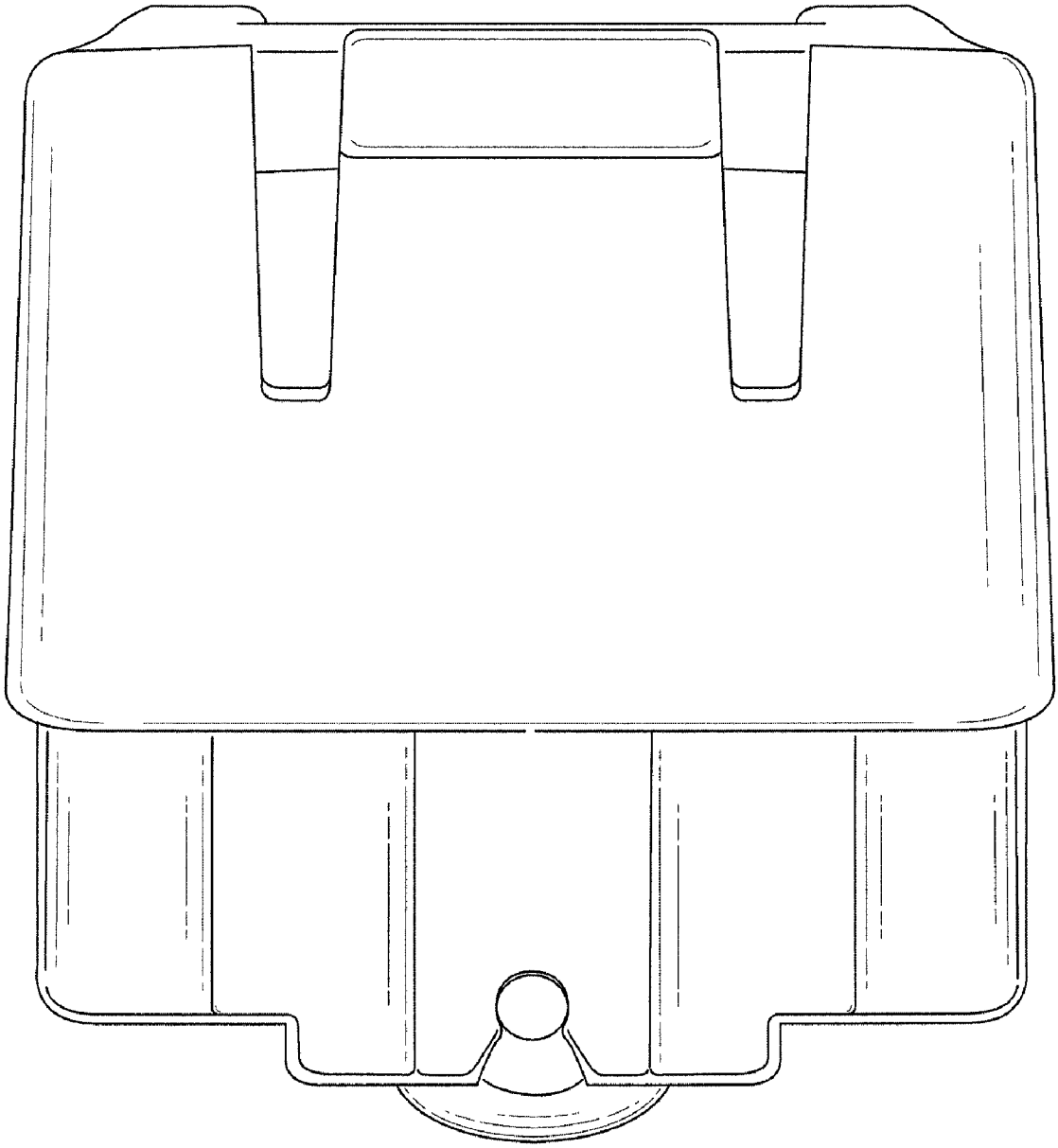
FIG. 16 shows a side view of a shock absorber tower according to one embodiment of the invention.

FIGS. 13, 14, 15, and 16 illustrate a further embodiment of a shock absorber combined with a wheel, herein referred to as a shock absorber tower 260, to allow the seat carrier ring 201 to rotate and bounce up and down independently of the seat support ring 202. As shown in FIG. 14, the shock absorber tower 260 of one embodiment includes an outer tower 261, compression springs 262, an inner tower 263, and a wheel 264. The outer tower 261 is a hollow, rectangular-shaped, open-ended cartridge with an upper face for providing a surface to engage the compression springs 262. In addition, the inner tower 263 is a hollow, rectangular-shaped, open-ended cartridge that includes a lower face for providing a surface to engage the compression springs 262. The outer tower 261 has an inner width and length dimension that is slightly larger than the outer width and length dimension of the lower tower 263, which allows the inner surface of the open-ended side of the outer tower 261 to fit around the outer surface of the open-ended side of the inner tower 263. To assemble the outer 261 and inner tower 263 with the compression springs 262 according to one embodiment, the compression springs 262 are placed upright inside the inner tower 263. Then, the open end of the outer tower 261 is moved over the compression springs 262 until the open end of the outer tower 261 overlaps the outer surface of the inner tower 263. FIG. 15 illustrates an embodiment of an assembled shock absorber tower 260 when the compression springs 262 are uncompressed, and FIG. 16 illustrates an embodiment of an assembled shock absorber tower 260 when the compression springs 262 are compressed.

Referring back to FIG. 14, the inner tower 263 further includes a wheel 264 with an axis of rotation perpendicular to the central vertical axis B or C of the seat support ring 202 or the seat carrier ring 201, respectively. In an alternative embodiment, which is not shown, a bearing roller can be used in lieu of a wheel 264.

In one embodiment, as shown in FIGS. 13 and 14, the outer tower 261 further includes a spring tab 265 located on an outer face of the outer tower 261 for engaging a slot 225 defined along the outer wall 222 of the seat carrier ring 201. The engagement of the tab 265 into the slot 225 mounts the outer tower 261 to the seat carrier ring 201 such that when the seat carrier ring 201 moves up or down, the outer tower 261 moves with the seat carrier ring 201. In one embodiment, as shown in FIG. 13, two or more slots 225 may be provided along the outer wall 222 in a vertical arrangement for receiving the tab 265 of the shock absorber tower 260. The shock absorber tower 260 can be positioned in different slots to adjust the height of the seat carrier ring 201 relative to the seat support ring 202, which provides height adjustment for the child utilizing the apparatus. For example, when a child grows taller, the tab 265 of the shock absorber tower 260 is engaged into a lower slot 225b, which raises the height of the seat carrier ring 201 relative to the seat support ring 202. If a smaller child is to utilize the apparatus, the tab 265 of the shock absorber tower 260 is engaged into a higher slot 225a, which lowers the height of the seat carrier ring 201 relative to the seat support ring 202. To disengage, or adjust, the tab 265 from the slot 225, the tab 265 is pushed radially inwardly while the tower 260 is moved in the desired direction.

When the shock absorber tower 260 is mounted to the seat carrier ring 201 and the seat carrier ring 201 is mounted within the seat support ring 202, the wheel 264 is positioned adjacent the raceway defined by the shelf 233 of the seat support ring 202 and is configured to rotate about its axis when the seat carrier ring 201 rotates relative to the seat support ring 202.

Figure 17:
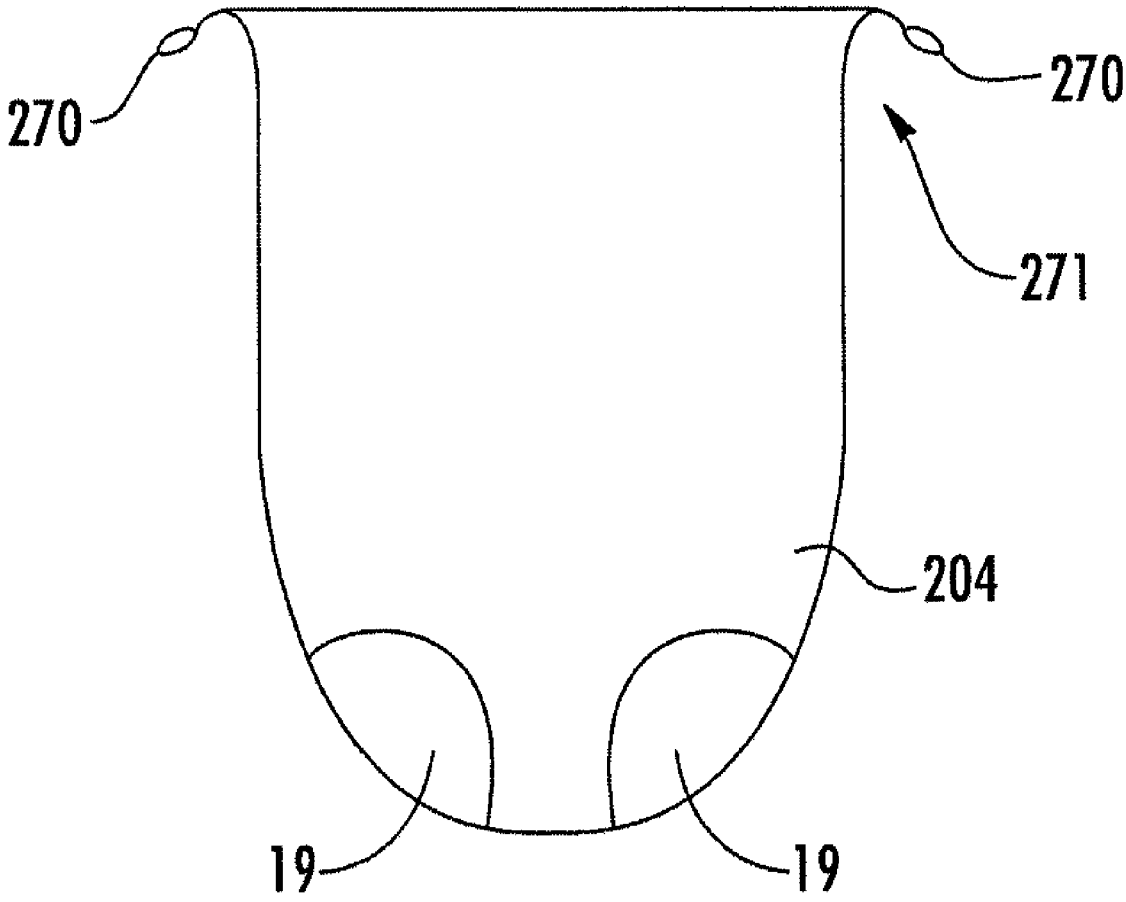
FIG. 17 shows a side view of a sling according to one embodiment of the invention.

FIGS. 13 and 17 illustrate one embodiment of the seat carrier ring 201 that includes attaches to a fabric sling 204 on which a child can sit. In one embodiment, shown in FIG. 17, the sling 204 includes a pair of leg openings 19 that allow the child to touch the floor 14 with its legs and loops 270 along the top portion 271 of the sling 204 to engage tabs 229 extending downwardly from the outer wall 221 of the seat carrier ring 201, which are shown in FIG. 13. The loops 270 are hooked over the tabs 229 to secure the sling 204 to the seat carrier ring 201.

According to various embodiments of the invention, the angular rotation of the seat support ring 202 and the seat carrier ring 201 relative to each other may be limited to less than 360°. For example, in one embodiment, the angular rotation is limited to about 100° relative to either side of a horizontal axis that extends through the central vertical axis of the activity table 11 and the central vertical axes B, C of the seat support ring 202 and the seat carrier ring 201, respectively. Limiting the angular rotation, according to various embodiments, decreases the likelihood that a child seated within the seat 12 can rotate the seat carrier ring 201 such that the child can walk along the supporting surface and move the orbital walker 10 along with the child.

In various embodiments of the invention, the angular rotation is limited by defining a first stop surface between the inner wall 231 and the outer wall 230 of the seat support ring 202 and a second stop surface between the inner wall 221 and the outer wall 222 of seat carrier ring 201. The first and second stop surfaces engage each other when the seat carrier ring 201 is rotated a certain degree relative to the seat support ring 202.

Figure 20:
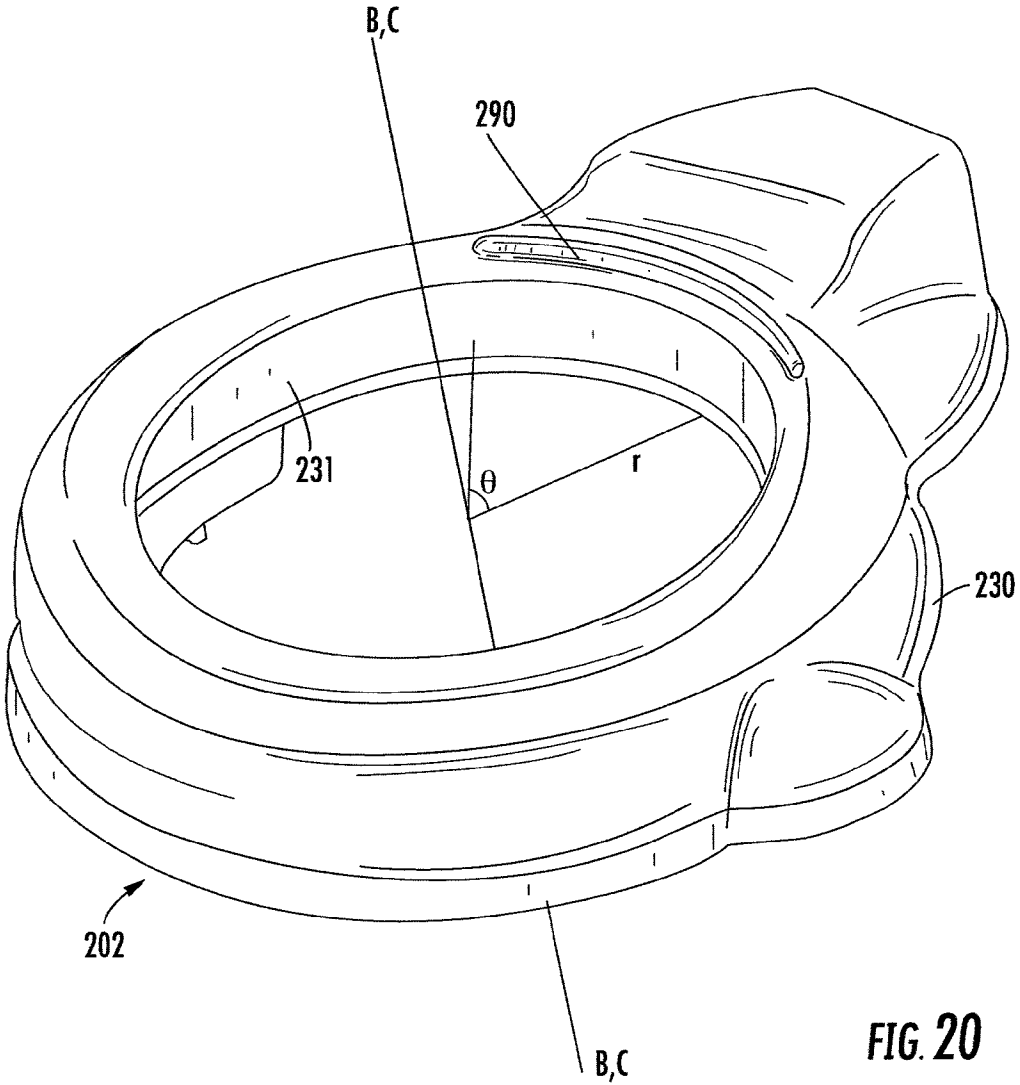
FIG. 20 shows a perspective view of an upper surface of a seat support ring according to various embodiments of the invention.

As shown in FIG. 20, according to various embodiments, the first stop surface comprises a stop rib 290 that extends upwardly from a horizontal surface extending between the inner wall 231 and the outer wall 230 of the seat support ring 202. In one embodiment, the stop rib 290 is arcuate shaped and its center lies along a vertical plane that extends through the connecting beam 16 and the central axes B, C of the seat support ring 202 and the seat carrier ring 201, respectively. The length of the stop rib 290 is determined by multiplying the distance r between the central axes B, C and the stop rib 290 and an angle Θ (in radians) through which the seat carrier ring 201 is prevented from rotating. In a particular embodiment in which the seat carrier ring 201 is limited to rotating about 100° relative to either side of the horizontal axis extending through the central vertical axis of the activity table 11 and the central axes B, C of the seat support ring 202 and the seat carrier ring 201, respectively, the length of the stop rib 290 is the product of about 2.79 radians (about 160°) and the distance r.

Figure 21:
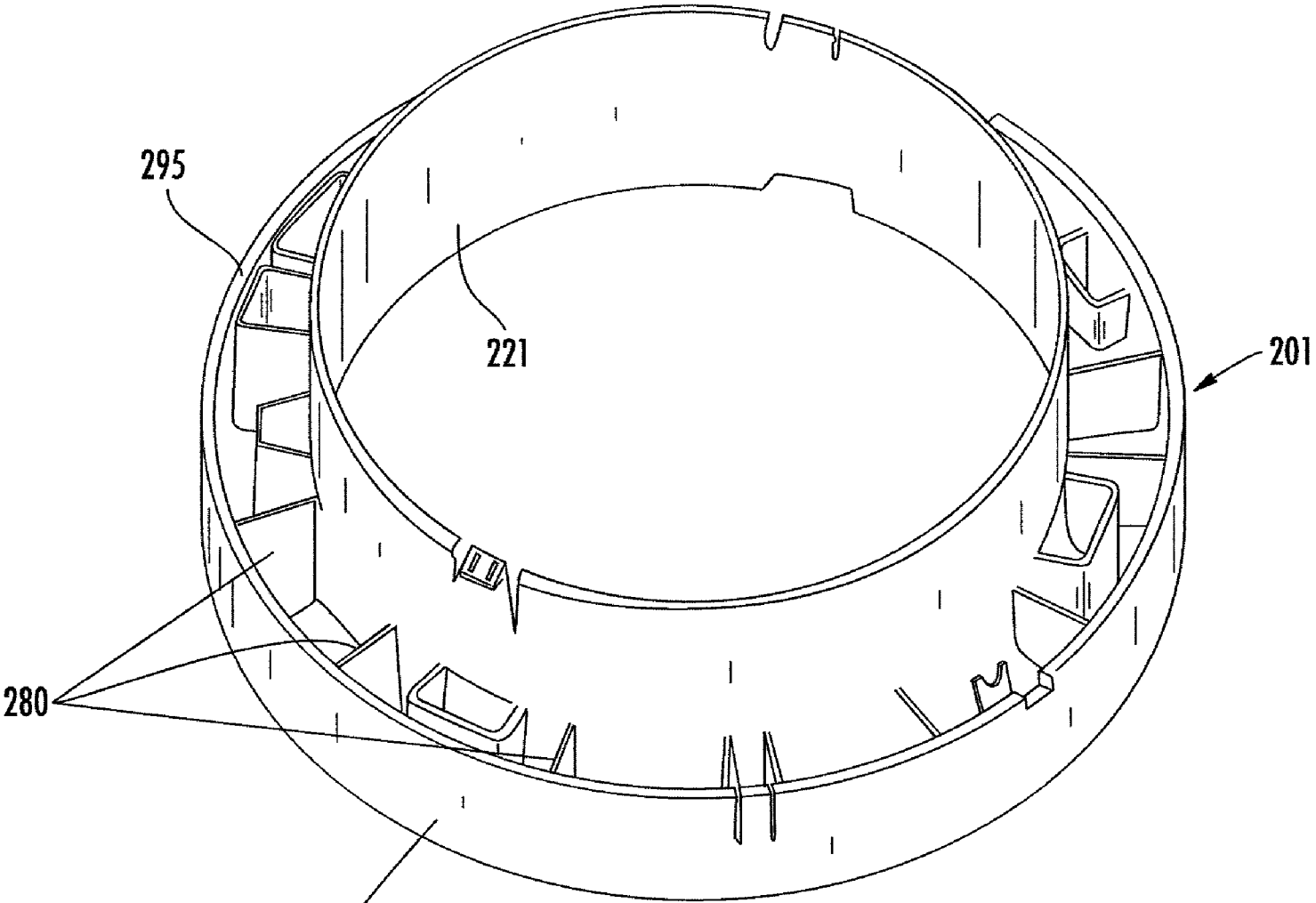
FIG. 21 shows a perspective view of a lower surface of a seat carrier ring according to various embodiments of the invention.

In addition, as shown in FIG. 21, the second stop surface of the seat carrier ring 201 according to various embodiments comprises at least two vertical ribs 280 that each extend between the inner wall 221 and the outer wall 222 of the seat carrier ring 201. In one embodiment, a lower edge of each of the vertical ribs 280 extends downwardly and is substantially coplanar with a lower edge 295 of the outer wall 222 of the seat carrier ring 201. The vertical ribs 280 are circumferentially spaced apart from each other and are positioned adjacent a portion 297 of seat carrier ring 201 where the child's back is positioned when seated in the seat 12.

Figure 22:
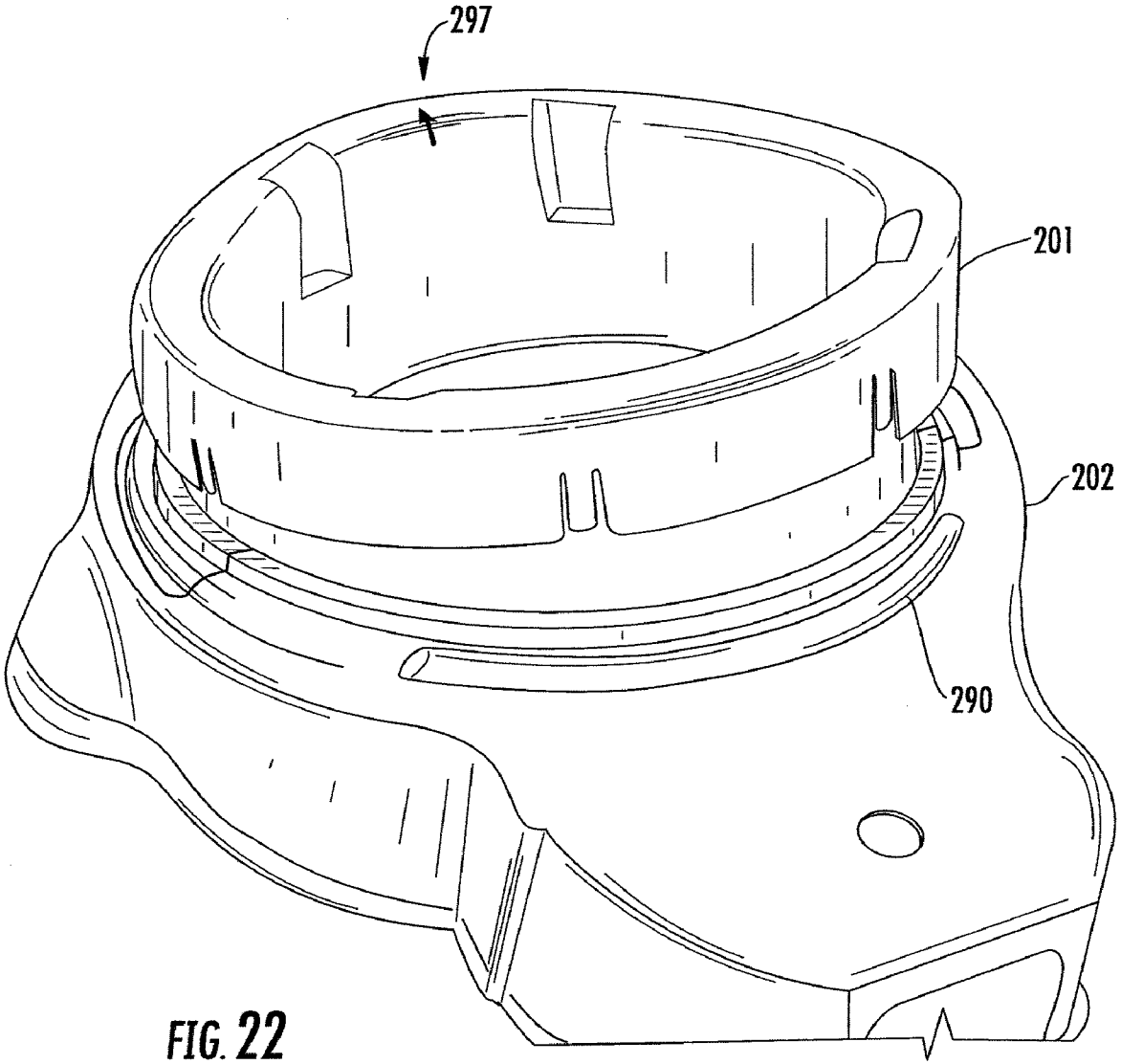
FIG. 22 shows a perspective view of the upper surfaces of the seat support ring and the seat carrier ring shown in FIGS. 20 and 21.

As shown in FIG. 22, according to various embodiments, when the seat carrier ring 201 is positioned within the seat support ring 202, the seat carrier ring 201 is substantially aligned with the seat support ring 202 such that the vertical ribs 280 are not positioned above the stop rib 290. In particular, in one embodiment, the vertical ribs 280 are positioned substantially horizontally opposite the stop rib 290 on the seat support ring 202 to ensure that the area F between the vertical ribs 280 through which the seat carrier ring 201 is not intended to rotate relative to the seat support ring 202 is not positioned over the stop rib 290.

In the particular embodiment shown in FIG. 21, the seat carrier ring 201 comprises four vertical ribs 280 such that the two outer ribs engage the stop rib 290 when the seat carrier ring 201 is positioned within the seat support ring 202 and is rotated a certain degree relative to the seat support ring 202. The two inner ribs ensure proper assembly of the seat carrier ring 201 relative to the seat support ring 202 by preventing the inner wall 221 of the seat carrier ring 201 to nest within the seat support ring 202 if the vertical ribs 280 and the stop rib 290 are vertically aligned. In addition, in the particular embodiments shown in FIGS. 20 and 21, the height of the stop rib 290 further prevents the seat carrier ring 201 from being coupled to the seat support ring 202 incorrectly by preventing the spring tabs 255 from reaching and engaging the lower surface of the inner wall 231 of the seat support ring 202.

Figure 23:
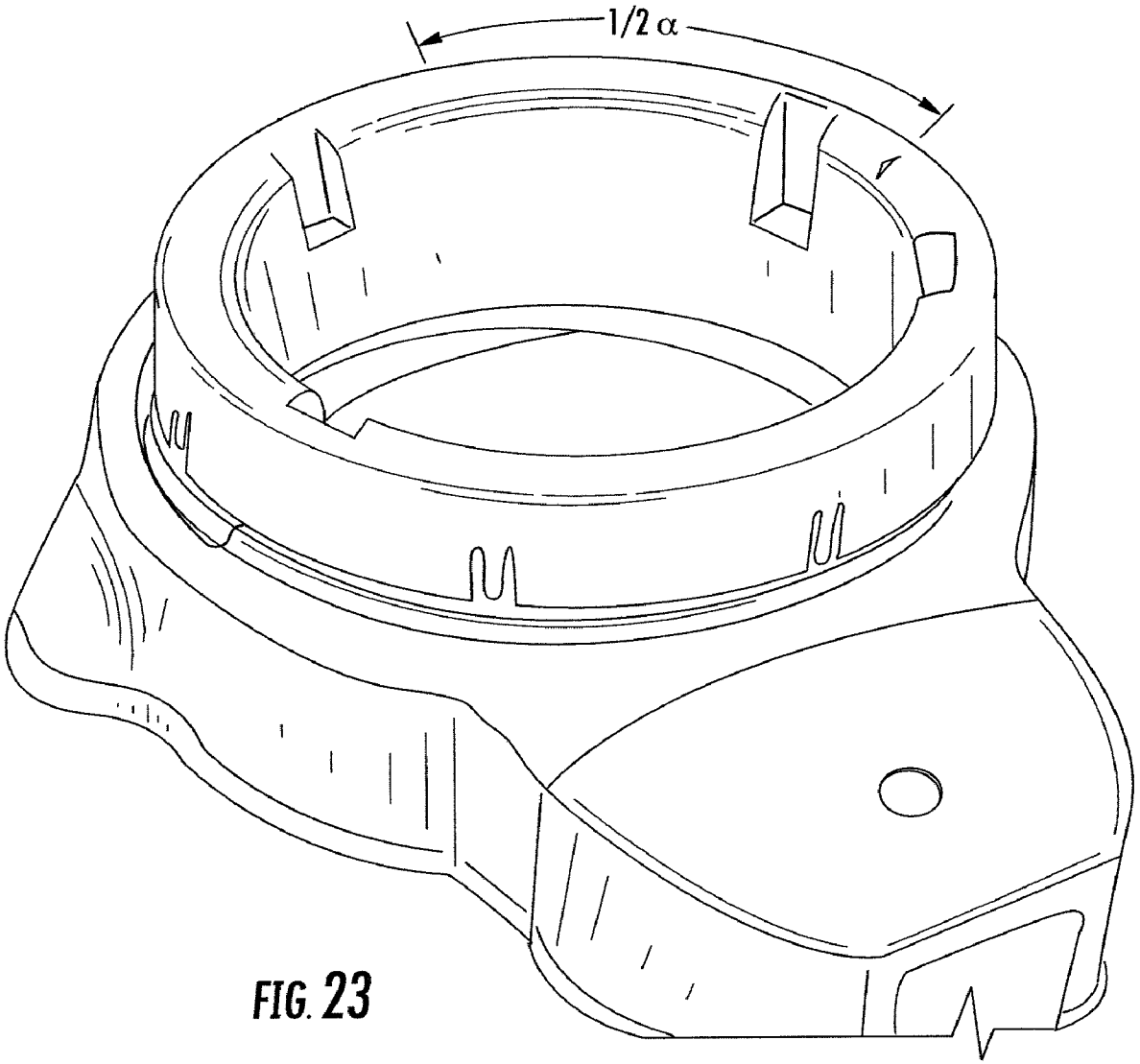
FIG. 23 shows a perspective view of the seat carrier ring shown in FIG. 21 rotated clockwise with respect to the seat support ring shown in FIG. 20 about 100°.
Figure 24:
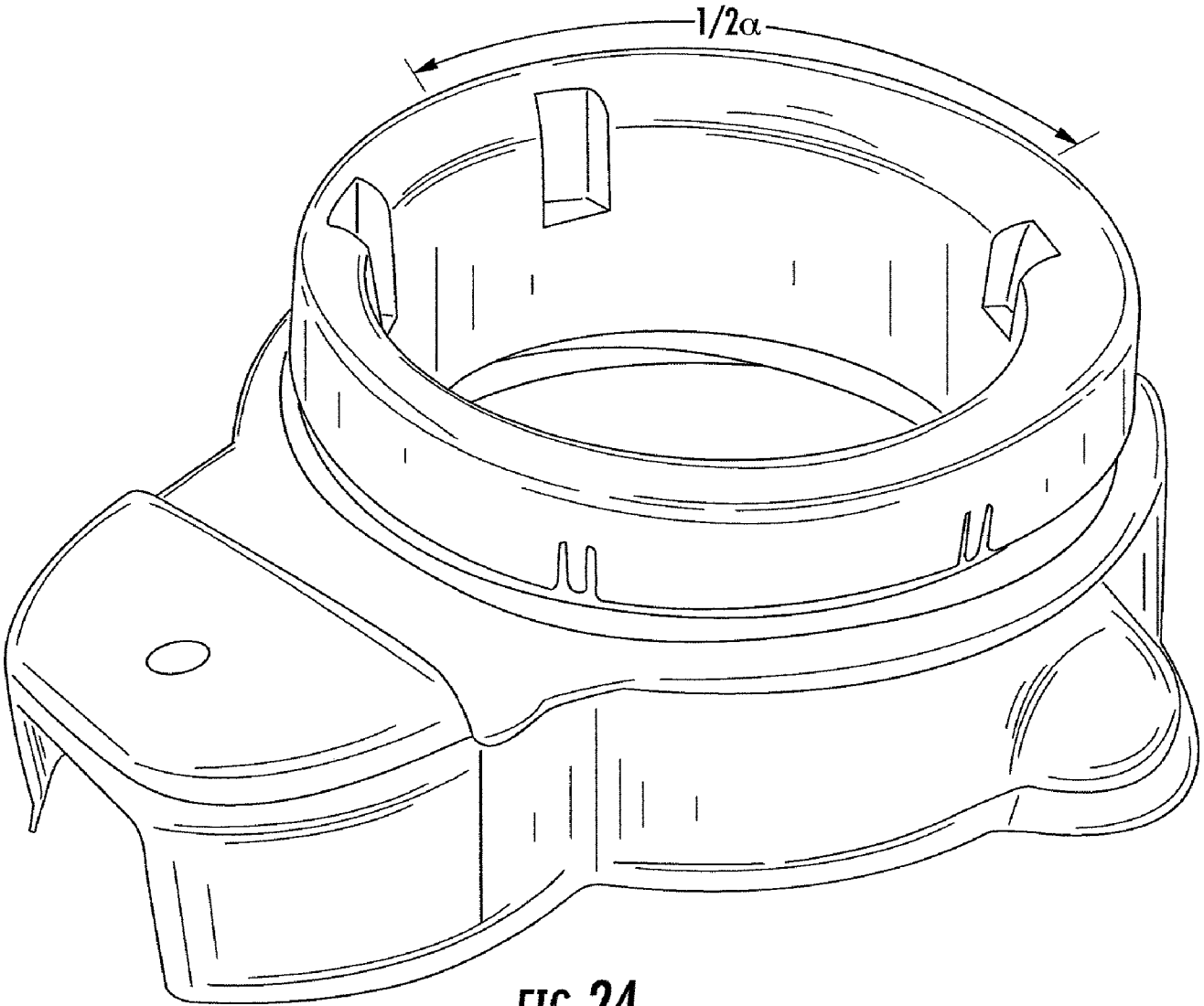
FIG. 24 shows a perspective view of the seat carrier ring shown in FIG. 21 rotated counter-clockwise with respect to the seat support ring shown in FIG. 20 about 100°.

When the seat carrier ring 201 is installed within the seat support ring 202, the seat carrier ring 201 can be rotated relative to the seat carrier ring 201 through an angle of rotation a that is equal to the difference between 360° and Θe. In the particular embodiment shown in FIGS. 23 and 24, the angle of rotation a is limited to about 200°, allowing the seat carrier ring 201 to rotate about 100° on each side of the horizontal axis that extends between the seat 12 and the activity table 11.

According to various embodiments of the invention, the stop rib 290 may be integrally formed with the seat support ring 202, which is shown in the embodiment in FIG. 20, or the stop rib 290 may be formed separately and coupled to the seat support ring 202 (not shown). In a particular embodiment in which the stop rib 290 is separately formed, the stop rib 290 can be raised or lowered relative to the surface of the seat support ring 202 on which the stop rib 290 is mounted. By lowering the stop rib 290, the user can allow the child seated within the seat carrier ring 201 to rotate 360° relative to the seat support ring 202, and by raising the stop rib 290, the user limits the angle through which the child can rotate the seat carrier ring 201 relative to the seat support ring 202.

In yet another embodiment, the stop rib 290 may be raised or lowered into more than two positions to provide a range of rotation for the child. For example, in a particular embodiment, the stop rib 290 may be adjusted among a first height, a second height, and third height, wherein the first height allows the seat carrier ring 201 full rotation (i.e., 360°) relative to the seat support ring 202, the second height limits the angle through which the child can rotate the seat carrier ring 201 relative to the seat support ring 202, and the third height prevents all rotation of the seat carrier ring 201 relative to the seat support ring 202. In various alternative embodiments, the vertical ribs 280 on the seat carrier ring 201 can be raised or lowered relative to the stop rib 290 to adjust the level of rotation similarly to the embodiments described above with respect to the raising and lowering of the stop rib 290.

According to various embodiments, the ability to raise and lower the stop rib 290 may be accomplished using various mechanisms that would be known to one of ordinary skill in the art, such as, for example, using a lever, a cam mechanism, or a spring-loaded mechanism. In a particular embodiment in which the stop rib 290 (or the vertical ribs 280) are incorporated as part of a mechanism that can be selectively retracted or deployed to allow for or limit the rotation of the seat carrier ring, the mechanism includes one or more cam surfaces that can be rotabably deployed to urge the stop rib 290 upwardly (and/or the vertical ribs 280 downwardly) to limit or prevent the rotation of the seat carrier ring 201 or retracted to urge the stop rib 290 downwardly (and/or the vertical ribs 280 upwardly) to allow for full rotation of the seat carrier ring 201. According to various other embodiments, the mechanism includes one or more pins that are moveable along one or more vertical axes that are substantially perpendicular to the plane on which the seat carrier ring 201 travels. The one or more pins may be housed either within the seat carrier ring 201 or the seat support ring 202 or both, according to one embodiment. In a further embodiment, the one or more pins are spring-loaded, which assists in the deployment and retraction of the one or more pins. In an alternative embodiment, the stop rib 290 and/or the vertical ribs 280 may be removed from or inserted into a corresponding pocket or other feature of the apparatus. For example, in one embodiment, the stop rib 290 may be inserted into a slot in the horizontal surface that extends between the inner wall 231 and the outer wall 230 of the seat support ring 202. Similarly, in another embodiment, the vertical ribs 280 may be removed from or repositioned relative to the inner wall 221 and the outer wall 220 of the seat carrier ring 201. In yet another embodiment, the stop rib 290 and/or the vertical ribs 280 may be removed from the seat support ring 202 or seat carrier ring 201 and stored on the apparatus while not being used to avoid being misplaced.

In another embodiment of the invention, the first stop surface comprises at least two protrusions, such as pins, for example, that extend upwardly from the horizontal surface that extends between the inner wall 231 and the outer wall 230 of the seat support ring 202. The at least two protrusions are positioned at the edges of the path of rotation allowed for the seat carrier ring 201 relative to the seat support ring 202.

According to various other embodiments, the stop rib 290 or the protrusions may be positioned on the seat carrier ring 201 and a corresponding stop surface, such as vertical ribs or mating protrusions, may be positioned on the seat support ring 202 to limit the angular rotation of the seat carrier ring 201 with respect to the seat support ring 202.

Activity Table

Figure 4:
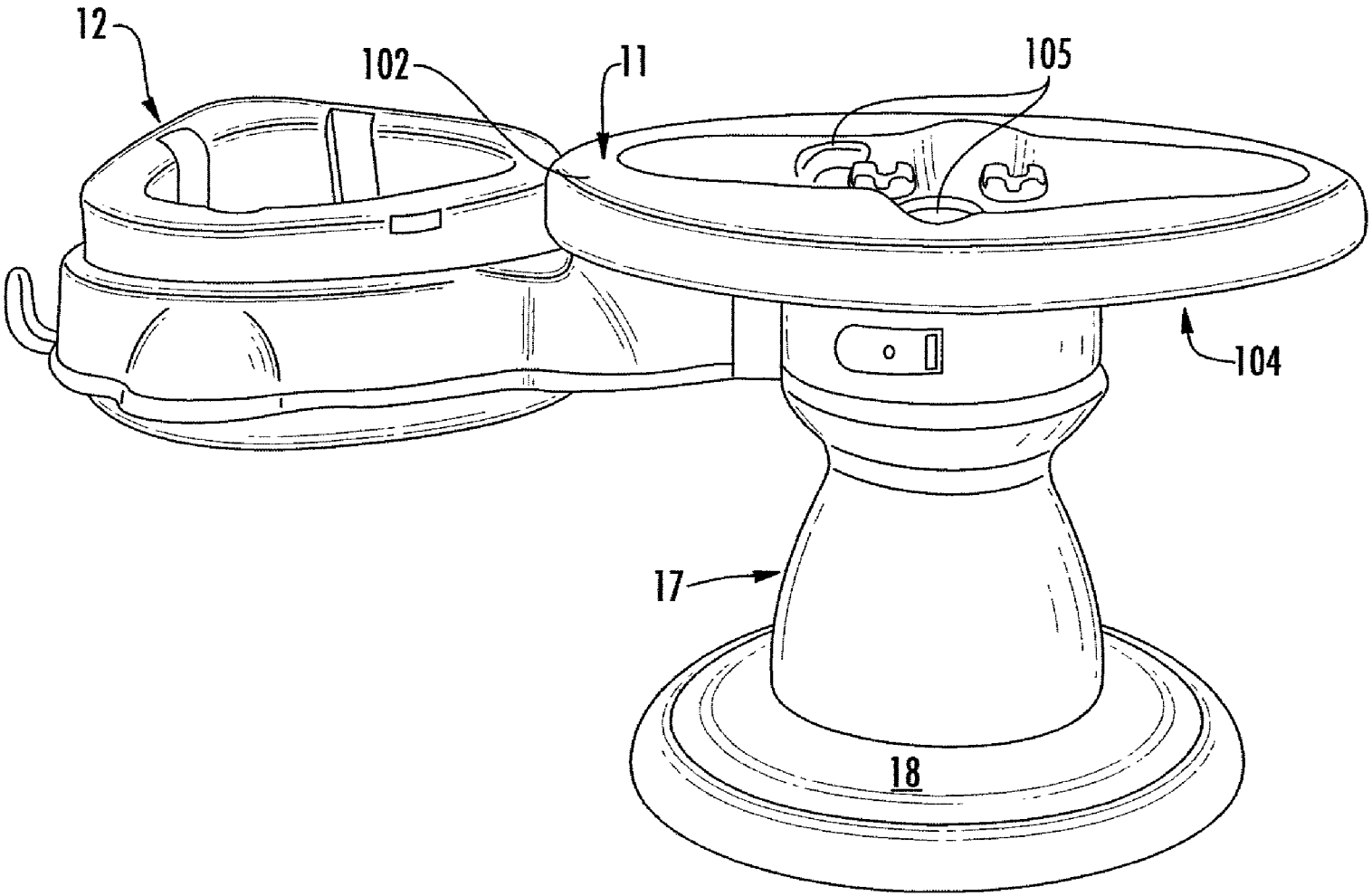
FIG. 4 shows a perspective view of an orbital walker according to one embodiment of the invention.

In the embodiment of the activity table 11 shown in FIG. 4, the activity table 11 has an upper surface 102 and an underside 104. The upper surface 102 is configured for receiving and supporting one or more children's activity items 103. In one embodiment, the activity table 11 is adapted for receiving and supporting one or more children's activity items 103 on its upper surface 102. In one embodiment, as shown in FIG. 4, the upper surface 102 of the activity table 11 includes depressed receptacles 105 that are dimensioned to receive activity items 103 that have engagement portions for mating with the depressed receptacles 105. For example, the upper surface 102 of the table 11 shown in FIG. 3 includes eight receptacles 105. In one embodiment, each receptacle 105 can be configured to receive a different type of activity item 103, such as a magnetic drawing pad, an electronic piano, a mechanical, or physically interactive toy, and a tray for holding food. A piano is a term used to describe a mechanical or electrical activity item that includes keys or buttons for the child to push, and in response to the child pushing the keys or buttons, music, voice, or other sounds are played. Mechanical toys can include bead-chasers, spring loaded toys that vibrate back and forth when pulled or pushed, toys mounted on an axis that spin when force is applied to the toy. Other activity items that can be mounted to the table include stalk toys, such as rattle balls, water or gel-filled teething toys, mirrors, and squeakers.

The ability of being able to easily detach and attach the seat to the table using the connecting beam allows the table to be used in combination with the seat as a walker and allows the table to be used on its own as an interactive learning center. For example, a four month old child benefits from having the seat portion attached to the activity table because the seat allows the child to bounce and practice walking while the child is working to develop the strength required to support himself. In addition, smaller children have different interests than older children, so the activity table provides the stalk toys to mentally stimulate the younger children.

However, when the child grows older and the child's legs become strong enough to support the child and allow the child to walk, the child no longer needs the seat. At this stage, the seat can be readily removed from the table, and the table can serve as a stand-alone activity center. As mentioned earlier, the activity table includes activity items, such as the magnetic drawing pad, the electronic piano, and the mechanical items, that are more suitable for an older child.

Figure 18:
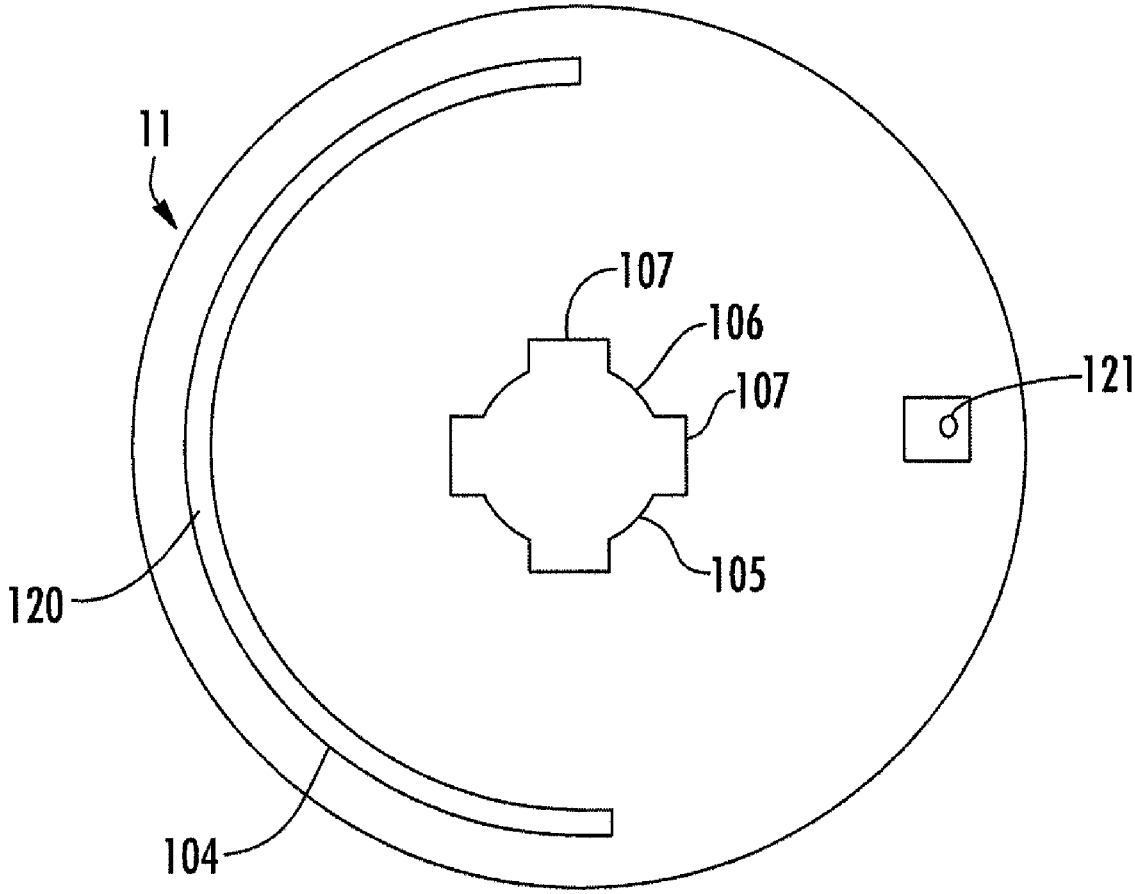
FIG. 18 shows a bottom view of an activity table according to one embodiment of the invention.

The underside 104 of the activity table 11, shown in FIG. 18, includes an attachment portion 105 in the center of the table 11 for mounting the table 11 to the pedestal 17. In one embodiment, as shown in FIG. 8, the top surface 110 of the pedestal 17 includes two or more fingers 111 that extend horizontally and outwardly from the periphery of the pedestal 17. As shown in FIG. 17, the attachment portion 105 of the table 11 defines slots 107 for receiving the fingers 111 and an annular flange 106 extending between each slot 107. To assemble the table 11 to the pedestal 17, the fingers 111 of the pedestal 17 are aligned with the slots 107 of the attachment portion 105. The table 11 is pushed towards the pedestal 17 so that the fingers 111 of the pedestal 17 pass through the slots 107. Then, the table 11 is rotated in one direction to move the fingers 111 behind the annular flanges 106, which prevents the table 11 from moving relative to the pedestal 17 unless the table 11 is rotated to realign the fingers 111 and the slots 107.

Referring to FIG. 18, in a further embodiment, the underside 104 of the table 11 defines an annular raceway 120 that extends partially around the table 11 and one or more stop holes 121. In this embodiment, a locking pin 240, which is described below in relation to FIG. 19, engages the annular raceway 120 to prevent the child from moving the seat 12 past the path defined by the raceway 120. In another embodiment, the pin 240 can be engaged into the stop hole 121 to prevent the child from moving the seat 12 in any direction.

For example, in one embodiment, the apparatus can provide for at least three modes of operation: (1) 360° movement, or free-walking, which allows the child to move the seat 12 in an orbital path 15 360° around the table 11, (2) 180° arc movement, which allows the child to move the seat 12 in the orbital path 15 180° around the table 11, and (3) a lock, or stationary, mode, which locks the seat 12 in one position to prevent movement of the seat 12 along the orbital path 15. The lock, or stationary, mode is used in one embodiment to prevent movement of the child while the child is eating snacks.

Figure 19:
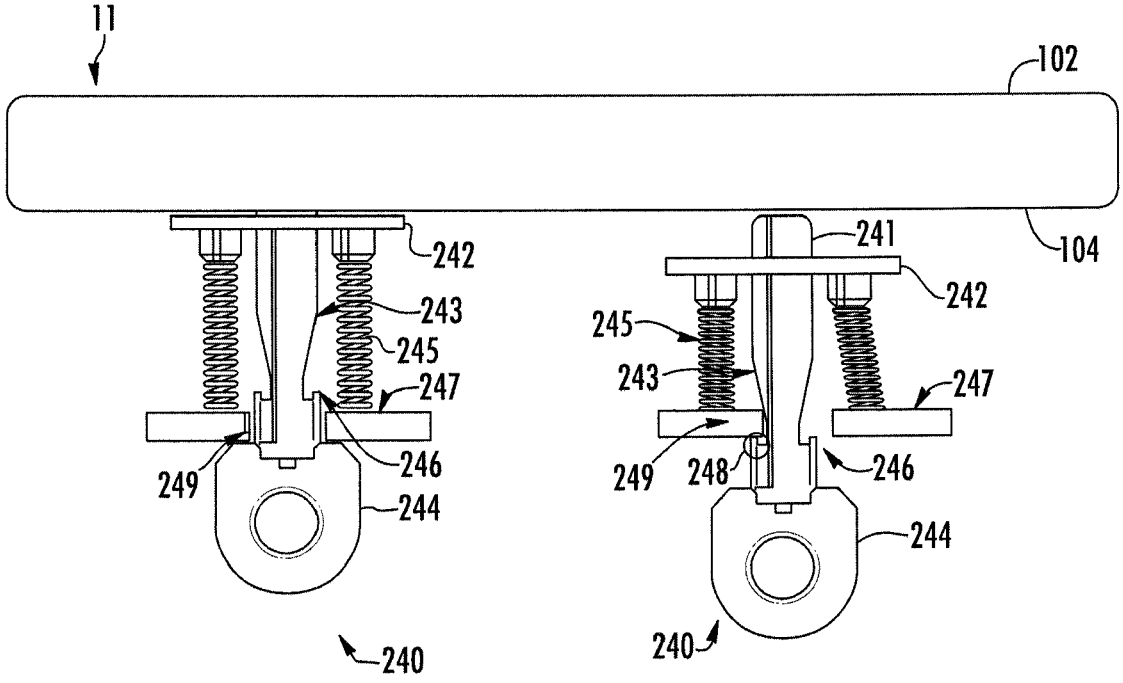
FIG. 19 shows a side view of a locking pin according to one embodiment of the invention.

In one embodiment, shown in FIG. 19, a locking pin 240 is utilized to control the movement of the seat 12 relative to the orbital path 15 around the table 11. The locking pin 240, according to one embodiment shown in FIG. 19, includes an elongated body 243 that has a top portion 241 and a bottom portion 244. A T-shaped bar 242 is positioned between the top portion 241 and the bottom portion 244, and two compression springs 245 are positioned between the bottom surface of the T-shaped bar 242 and a horizontal surface 247 inside of the connecting beam 16. Above and adjacent to the bottom portion 244 is an engagement portion 246. The engagement portion 246 extends wider than the body 243, and in one embodiment, includes a finger 248 extending upwardly on the end of each side of the engagement portion 246 for hooking onto an adjacent surface on the connecting beam 16. As shown in FIG. 10, the locking pin 240 is mounted vertically through the end 640 of the connecting beam 16 such that at least a portion of the bottom portion 244 of the pin 240 extends below the connecting beam 16 when the pin 240 is in an engaged position, which is described below. As shown in FIGS. 10 and 11, the upper surface of the connecting beam 16 and the beam connector portion 232 each define a hole 642, 270, respectively, for allowing the top portion 241 of the pin 240 to pass through the holes 642, 270 when the springs 245 are disengaged and the pin 240 is in an engaged position.

To disengage the pin 240, which prevents the top portion 241 of the pin 240 from limiting the movement of the seat 12, the bottom portion 244 of the pin 240 is pulled downwardly, causing the top portion 241 of the pin 240 to move below the upper surface of the connecting beam 16 and the bottom surface of the T-shaped bar 242 to move into engagement with the compression springs 245. To keep the pin 240 in this configuration, the pin 240 is moved to the right or left while being pulled downwardly, such that the engagement portion 246 on the pin is moved below the lower surface 649 of the connecting beam 16. When the pin 240 is released, the engagement portion 246 maintains frictional contact with the lower surface 649 of the connecting beam 16 due to the upward force provided by the compression springs 245. To engage the pin 240, the pin 240 is pulled downwardly and pivoted back towards its center position. The engagement portion 246 of the pin 240 fits through the hole 650 in the lower surface 649 of the connecting beam 16, which allows the compression springs 245 to disengage and push the T-shaped bar 242 upwardly, moving the top portion 241 of the pin 240 above the upper surface of the connecting beam 16.

If it is desired for the seat 12 to be able to rotate 360° along the orbital path 15 around the table 11, the pin 240 should be positioned in a disengaged position, as described above, wherein the top portion 241 of the pin 240 is positioned below the top surface of the connecting beam 16. If it is desired for the seat 12 to be able to rotate 180° around the table 11, the seat 12 is rotated to a position in which the connecting beam 16 is below the annular raceway 120 defined by the underside 104 of the table 11. The pin 240 is then released from its disengaged position, allowing the compression springs 245 to urge the T-shaped bar 242 upwardly, which pushes the top portion 241 of the pin 240 into the raceway. Having the pin 240 engaged into the raceway 120 limits the movement of the seat 12 along the orbital path 15 around the table 11. If it is desired to prevent the seat 12 from making any orbital movement, the seat 12 can be rotated until the connecting beam 16 is aligned with a stop hole 121. Once aligned, the pin 240 can be engaged, causing the top portion 241 of the pin 240 to extend past the upper surface of the connecting beam 16 and into a stop hole 121 defined by the underside 104 of the table 11. The pin 240 prevents the seat 12 from orbital movement relative to the table 11. In one embodiment, a stop hole 121 is located below the portion of the table 11 that receives a snack tray for holding food to keep the child focused on its snack. However, one or more stop holes 121 could be positioned at any location on the underside 104 of the table 11.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A children's exercise and activity apparatus for providing activities for small children and exercise functionality, said apparatus comprising:

an activity table adapted for receiving one or more children's activity items, the activity table having an upper surface for supporting the activity items when placed thereon;

a seat for supporting a child above the floor, the seat defining a pair of leg openings that allow the child to touch the floor with its legs;

a connecting beam for connecting the seat to the activity table at a location on the activity table below the upper surface of the activity table, the connecting beam being rotatably connected to the activity table so that the child in the seat can travel in an orbital path around the activity table; and one or more legs connected to and depending downwardly from the seat to the floor to support the seat and prevent the seat from tipping over when a child is supported therein;

wherein said seat comprises:

a seat support ring having a first central vertical axis, an inner wall, an outer wall, and a first stop surface positioned between said inner wall and said outer wall of said seat support ring; and a seat carrier ring having a second central vertical axis, an inner wall, an outer wall, and a second stop surface positioned between said inner wall and said outer wall of said seat carrier ring;

wherein said inner wall of said seat carrier ring is positioned adjacent said inner wall of said seat support ring such that said first central axis is coaxial with said second central axis and said seat carrier ring can rotate about said central axes independently of said seat support ring, and wherein said second stop surface of said seat carrier ring is configured for engaging said first stop surface of said seat support ring when said seat carrier ring is rotated relative to said seat support ring to limit an angular rotation of said seat carrier ring relative to said seat support ring about said central axes.

2. The apparatus of claim 1 wherein said first stop surface comprises a stop rib that extends upwardly from a horizontal surface extending between said inner wall and said outer wall of said seat support ring and said second stop surface comprises at least one vertical rib that extends between said inner wall and said outer wall of said seat carrier ring.

3. The apparatus of claim 2 wherein said stop rib has an arcuate shape.

4. The apparatus of claim 2 wherein said at least one vertical rib comprises two vertical ribs each having a lower edge, said lower edges being coplanar with a lower edge of said outer wall.

5. The apparatus of claim 1 wherein said first stop surface is integrally formed with said seat support ring.

6. The apparatus of claim 1 wherein said second stop surface is integrally formed with said seat carrier ring.

7. The apparatus of claim 1 wherein said first stop surface is separately formed from said seat support ring and is removably attachable to said seat support ring.

8. The apparatus of claim 1 wherein said second stop surface is separately formed from said seat carrier ring and is removably attachable to said seat carrier ring.

9. The apparatus of claim 1 wherein said first stop surface is coupled to said seat support ring and is movable between a raised position and a lowered position.

10. The apparatus of claim 9 wherein said seat support ring further comprises a levering mechanism operable for moving said first stop surface between said raised position and said lowered position.

11. The apparatus of claim 9 wherein said seat support ring further comprises a cam mechanism coupled to said seat support ring operable for moving said first stop surface between said raised position and said lowered position.

12. The apparatus of claim 9 wherein said seat support ring further comprises one or more spring-loaded pins coupled to said seat support ring operable for moving said first stop surface between said raised position and said lowered position.

13. The apparatus of claim 1 wherein said second stop surface is coupled to said seat carrier ring and is movable between a raised position and a lowered position.

14. The apparatus of claim 13 wherein said seat carrier ring further comprises a levering mechanism operable for moving said second stop surface between said raised position and said lowered position.

15. The apparatus of claim 13 wherein said seat carrier ring further comprises a cam mechanism operable for moving said second stop surface between said raised position and said lowered position.

16. The apparatus of claim 13 wherein said seat carrier ring further comprises one or more spring-loaded pins coupled to said seat carrier ring operable for moving said second stop surface between said raised position and said lowered position.

17. The apparatus of claim 1 wherein said first stop surface is at least two protrusions that extend upwardly from a horizontal surface extending between said inner wall and said outer wall of said seat support ring.

18. The apparatus of claim 1 wherein said second stop surface is at least two protrusions that extend downwardly from a horizontal surface extending between said inner wall and said outer wall of said seat carrier ring.

19. The apparatus of claim 18 wherein a lower surface of each of said protrusions extends substantially coplanar with said outer wall of said seat carrier ring.

20. The apparatus of claim 1 wherein said angular rotation is limited to about 100°0 on each side of a horizontal axis extending between said seat and said activity table.

* * * * *